US005645192A

United States Patent [19]

Amidzich

[11] Patent Number: 5,645,192

[45] Date of Patent: Jul. 8, 1997

[54] SELF REGULATING VALVE ASSEMBLY FOR CONTROLLING FLUID INGRESS AND EGRESS FROM A TRANSPORTABLE CONTAINER WHICH STORES AND DISTRIBUTES LIQUID UNDER PRESSURE

[75] Inventor: Bradford G. Amidzich, Oconomowoc, Wis.

[73] Assignee: Vent-Matic Co., Inc., Milwaukee, Wis.

[21] Appl. No.: 723,295

[22] Filed: Sep. 30, 1996

Related U.S. Application Data

[60] Provisional application No. 60/008,459, Dec. 11, 1996.

[51] Int. Cl.[6] ..... B65D 83/14

[52] U.S. Cl. ..... 222/1; 222/397; 222/400.7; 137/212

[58] Field of Search ..... 222/396, 397, 222/400.7, 400.8; 137/212, 322

[56] References Cited

U.S. PATENT DOCUMENTS

| | | | |
|---|---|---|---|
| 3,596,810 | 8/1971 | Taubenheim | 222/400.7 |
| 3,672,390 | 6/1972 | Gravesteijn | 222/400.7 X |
| 4,125,209 | 11/1978 | Bailey | 222/400.7 |
| 4,142,658 | 3/1979 | Golding | 222/400.7 |
| 4,458,833 | 7/1984 | Bailey | 222/400.7 |
| 4,548,343 | 10/1985 | Gotch | 137/212 X |
| 4,592,105 | 6/1986 | Lewins | 222/400.7 X |
| 5,242,092 | 9/1993 | Riis et al. | 222/400.7 |

FOREIGN PATENT DOCUMENTS

| | | | |
|---|---|---|---|
| 2123347 | 5/1971 | Germany | 137/212 |

*Primary Examiner*—Kevin P. Shaver
*Attorney, Agent, or Firm*—Nilles & Nilles, S.C.

[57] ABSTRACT

A valve assembly, securable in an upper opening of a container for liquids, is simple and inexpensive to manufacture yet provides improved operability and is capable of relieving excess gas pressure within the container. The valve assembly preferably includes a stub and a riser pipe/valving unit detachably mounted in the stub. The valving unit substantially consists of a unified riser pipe having blockable gas and/or liquid portals, and movable members arranged co-axially within two upper reception areas in the riser pipe and including a single sealing ring and a dispensing tower. The sealing ring is axially displaceable against the pressure of a spring to move from a neutral closed position to a lower open position by way of external activation. One of the sealing ring and the dispensing tower is movable axially relative to the other, under lifting forces imposed by excess gas pressure within the container, from a neutral closed position to a venting position, thereby venting some gas from the container and regulating container pressure.

22 Claims, 16 Drawing Sheets

SELF REGULATING VALVE ASSEMBLY FOR CONTROLLING FLUID INGRESS AND EGRESS FROM A TRANSPORTABLE CONTAINER WHICH STORES AND DISTRIBUTES LIQUID UNDER PRESSURE

CLAIM FOR DOMESTIC PRIORITY

Domestic priority is hereby claimed under 35 USC § 119(e) based upon Provisional Application Ser. No. 60/008,459, filed Dec. 11, 1996 in the name of the inventor named in the present application and entitled "SELF REGULATING VALVE ARRANGEMENT FOR TRANSPORTABLE CONTAINER FOR STORING AND DISTRIBUTING LIQUID UNDER PRESSURE."

BACKGROUND OF THE INVENTION

The invention relates to valve arrangements or valve assemblies and, in particular, relates to valve assemblies for transportable containers of the type serving to store and distribute a liquid under pressure from a propellant gas. The liquid to be stored and dispensed could comprise a beverage, a concentrate, a plant protection agent, or virtually any other transportable liquid.

The typical valve assembly of the above-mentioned type comprises (1) a ring-shaped stub secured in an upper opening of a container such as a barrel; (2) a valve housing; (3) a riser pipe arranged co-axially with an upper reception area in the valve housing such that the riser pipe and outlet valve can be displaced axially, against the biasing force of springs mounted within and about the valve housing, from an upper closed valve position to a lower open valve position; and (4) retaining parts which hold all parts in position within the stub. In previously-known valve assemblies of this type, the valve assembly can be readily disassembled before the gas pressure in the container has been fully relieved. Residual gas pressure in the container can force the valve components out of the container opening at high velocities with substantial risk to personnel and/or surroundings.

The problem of unauthorized disconnection of a pressurized container is addressed and at least partially solved in U.S. Pat. No. 5,242,092 to Riis et al. (the Riis patent). The valve assembly disclosed in the Riis patent includes, in addition to the stub, the riser pipe, valves, and springs, an obliquely and downwardly protruding finger provided on the lower free end of the riser pipe. The finger is spaced from the top of the riser pipe and cooperates with the remainder of the riser pipe such that the valve can only be dismounted completely when the riser pipe is in or in the vicinity of its bottommost position. Since pressure within the container forces the riser pipe upwardly and the finger therefore can be pushed into its lower position only in the absence of significant pressure within the container, the finger functions to prevent damage which might occur if unauthorized persons were to attempt to disconnect the valve before the gas pressure in the container has been completely relieved.

The valve assembly disclosed in the Riis patent, though solving at least one of the problems exhibited by most valve assemblies, does not solve other problems associated with conventional valve assemblies. For instance, it cannot relieve excessive gas pressures within the container which may be generated when the container is subjected to external forces such as excessive shaking or other mechanical agitation or fire or other thermal agitation. The valve assembly disclosed in the Riis patent and other, traditional valve assemblies are designed only to keep the contents within the container, not to regulate the pressure within the container. Hence, traditional valve assemblies cannot prevent gas pressures within the container from reaching or even exceeding explosive levels in the presence of external agitation forces. Even if these external forces are less severe such that gas pressures within the container do not reach explosive levels, the higher-than desired pressure within the container still may render the contents dangerous to handle when making connection to dispensing equipment.

Another problem associated with previously-known valve assemblies is the problem of unintended and premature liquid escape during valve coupling. Presently-available valve assemblies are designed to cooperate with a coupling head which can be fixed in the valve or on the stub to form a sealed coupling. The coupling head, such as that manufactured by Perlick under the model number MK-1, connects the valve with a source of pressurized gas and with a liquid dispenser such as tapper. When the coupling head is seated and activated, an axially displaceable spindle is forced downwardly, setting-in-motion a two stage valve opening sequence. First the spindle comes in contact with the liquid valve plug, forcing it downwardly against a spring within the riser pipe, thereby opening the liquid passage. The spindle continues downwardly while making contact with the riser pipe itself, forcing the riser pipe downwardly against a second spring so that the riser pipe moves downwardly opening the gas passage, thereby completing the sequence and theoretically dispensing liquid only after the coupling head has been sealed and gas pressure has been applied. However, due at least in part to the fact that there are two separate pathways in the present assemblies, one being for gas and one for liquid, the liquid contents of the container is pushed to the very exit point of the liquid pathway by pre-existing gas pressure within the container. Now, when a per-activated coupling head is pressed into the I.D. of the housing, it will enter the liquid pathway before the coupling head seals against the container, thereby allowing the liquid contents to escape from the valve assembly and into the ambient atmosphere during the interval of time between initial liquid pathway opening and the time that the coupling head seals against the container.

It can thus be seen that previously-existing valve assemblies do not self-regulate pressure in the container, are complicated structures, and therefore are expensive to manufacture. In addition, valve coupling and uncoupling are cumbersome and time-consuming operations which risk substantial liquid spills.

OBJECTS AND SUMMARY OF THE INVENTION

A first object of the invention is to provide a valve assembly which is configured to supply gas to a container and to dispense a liquid from the container under the resultant internal container pressure and which can self-regulate the internal container pressure.

Another object of the invention is to provide a valve assembly which meets the first object and which is retrofitable to existing containers.

Another object of the invention is to provide a valve assembly which meets at least the first object of the invention and which is simpler and more cost effective to manufacture and assemble than traditional valve assemblies.

A further object of the invention is to provide a valve assembly which meets at least the first object and which exhibits improved flow rates of ingress and egress.

Another object of the invention is to provide a valve assembly which meets the first object of the invention and which permits control of the sequencing of valve portal exposures to open and close.

Still another object of the invention is to allow only gas to be present at the egress portals of a valve assembly meeting the first object until a coupling seal is made, thereby preventing liquid spills.

A still further object of the invention is to facilitate valve assembly coupling and uncoupling.

In a particularly simple and advantageous embodiment of the invention, these objects are achieved by providing a valve assembly having (1) a single chamber which acts as the riser pipe and the valve housing interior with portals that are blockable, and (2) a central tower which communicates with blockable pathways that pass both liquid and gas, and (3) a bi-directional valve member which controls separation of gas and liquid and directional flow in the chamber, which allows only gas to be present at the point of coupling transition until the valve assembly is fully coupled, and which regulates the internal gas pressure of the container when no coupling is engaged. Moreover, according to the invention, fewer parts are used in the same space, allowing greater cross sectional ingress and egress areas, thereby improving fill and discharge rates and reducing costs to the end user while providing improved safety. The parts can be made to retrofit existing equipment which is also a cost incentive.

Specifically, the valve includes a riser pipe, a dispensing tower, and a sealing ring. The riser pipe, which is configured for mounting in an opening in the container, has an internal surface, a first end located remote from the opening, and a second end located adjacent the opening. An ingress/egress portal is formed in the riser pipe between the first and second ends thereof. The dispensing tower, which is positioned radially within the riser pipe, extends at least generally in parallel with the riser pipe. A chamber is formed between the external surface of the dispensing tower and the internal surface of the riser pipe. The sealing ring is positioned within the chamber and is slidable downwardly within the chamber (1) from a first position in which the sealing ring seals against the internal surface of the riser pipe at a location above the ingress/egress portal, and in which the sealing ring seals against the external surface of the dispensing tower and prevents fluid from flowing out of the valve assembly, and (2) to a second position in which the sealing ring seals against the internal surface of the riser pipe at a location beneath the ingress/egress portal allowing gas to flow into the container and prevent liquid from entering the gas chamber and in which the sealing ring seals against the external surface of the dispensing tower beneath the ingress/egress portal of said tower allowing liquid to pressure seal the riser pipe and permit liquid flow out of the container. Preferably, the relative positional relationship between the sealing ring, the riser pipe, and the dispensing tower is variable such that, in the event of a build-up of excessive gas pressure within the container, a pressure relief operation automatically commences in which at least one of the sealing ring and the dispensing tower move axially relative to the riser pipe. Upon this relative movement, the dispensing tower ingress/egress portals are exposed to atmosphere and vent excess pressure.

Another object of the invention is to provide an improved sealing ring for a valve assembly.

In accordance with another aspect of the invention, this object is achieved by providing a sealing ring comprising an annular member at last an external portion of which is formed from a polymeric material. A first sealing surface is provided on an outer peripheral surface of the sealing ring for sealing against a first member and for preventing fluid flow axially past the first sealing surface, the first sealing surface comprising bi-directional sealing lips which extends outwardly from the outer peripheral surface. A second sealing surface is provided on an inner peripheral surface of the sealing ring for sealing against a second member and for preventing fluid flow axially past the second sealing surface, the sealing lips that contact the sealing surface are angularly offset to allow an annular friction rib placement if needed and an a resultant space between them which further reduces friction. A plurality of centering projections extend away from at least one of the inner peripheral surface and the outer peripheral surface for engaging at least one of the first member and the second member while permitting fluid flow therepast, thereby maintaining a designated positional relationship between the sealing ring and the at last one member.

Still another object of the invention is to provide an improved method for dispensing liquid from a container under internal gas pressure within the container.

In accordance with still another aspect of the invention, this object is achieved by mechanically driving a sealing ring to move downwardly within the chamber (1) from a first position preventing gas or liquid flow out of the valve assembly, and (2) to a second position in which gas flows through the ingress/egress portal from above the sealing ring and liquid flows past the sealing ring from below and out of the valve assembly.

Preferably, gas pressure, generated within the container due to thermal or other external agitation, causes at least one of the sealing ring and the dispensing tower to move axially relative to the riser pipe such that the sealing ring seals against the retaining ring and/or riser pipe surface. Upon this relative movement, the dispensing tower ingress/egress portals are exposed to atmosphere and vent excess pressure.

The foregoing and other features and advantages of the invention will become apparent from the following detailed description of the preferred embodiments, read in conjunction with the accompanying drawings. The detailed description and drawings are merely illustrative rather than limiting, the scope of the invention being defined by the appended claims and equivalents thereof.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Figure 1:
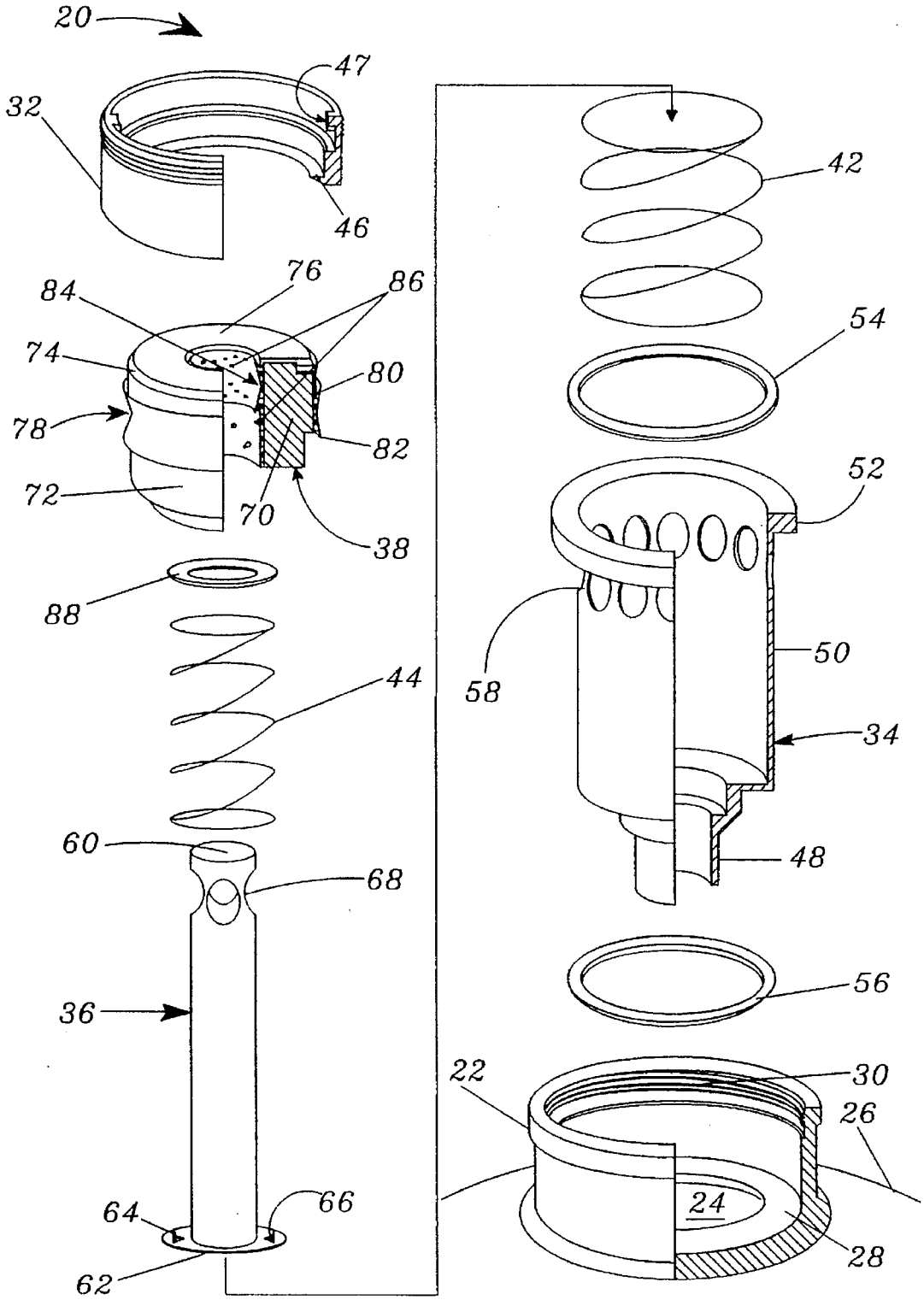
FIG. 1 is an exploded perspective view of the individual parts as they would be assembled together so as to make up a valve assembly according to a first embodiment of the invention.

Pursuant to the invention, a valve assembly has (1) a single chamber which acts as the riser pipe and the valve housing interior with portals that are blockable, and (2) a central tower which communicates with blockable pathways that pass both liquid and gas, and (3) a bi-directional valve member which controls separation of gas and liquid and directional flow in the chamber, which allows only gas to be present at the point of coupling transition until the valve assembly is fully coupled, and that regulates the internal gas pressure of the container when no coupling is engaged. Fewer parts are used in the same space, allowing for greater cross-sectional ingress and egress areas, thereby improving fill and discharge rates and reducing costs to the end user while providing improved safety. The parts can be made to retrofit existing equipment.

2. Description of First Embodiment

Turning now to the drawings and initially to FIGS. 1–4 in particular, the inventive valve assembly 20 is designed for connection to a standard stub 22 surrounding an aperture 24 in a container 26. Container 26 may comprise a barrel or any other transportable or stationary structure for storing beverages or other liquids and for dispensing the stored liquids under gas pressure. The stub 22 coaxially surrounds the aperture 24 in the container 26 and is fixed to the container 26, e.g., by welding. Stub 22 presents an internal radial shoulder 28 supporting the riser pipe 34 as detailed below and also presents upper radial threads 30 for connection to a housing 32 of the valve assembly 20 also as detailed below.

Valve assembly 20 includes as its major components a housing 32 which also functions as a retainer for the remaining components of the valve assembly 20, a stationary riser pipe 34, a dispensing tower 36, and a sealing ring 38. An annular chamber 40 is formed between the dispensing tower 36 and the riser pipe 34. This single chamber 40 contains liquid and/or gas depending upon the vertical position of sealing ring 38 within the chamber 40. Dispensing tower 36 of the illustrated embodiment is movable vertically with respect to the riser pipe 34. The sealing ring 38 and dispensing tower 36 are biased towards the positions illustrated in FIG. 2 by first and second springs 42 and 44 detailed below.

The housing 32, which is threaded into the threads 30 of the stub 22, serves to enclose the remaining components of the valve assembly 20 and to retain them in place during operation of the assembly. The housing 32 presents an internal ring 46 which defines an upper limit of travel of the sealing ring 38 as detailed below. Housing 32 also presents inwardly-extending radially lugs 47 for cooperation with a conventional coupling head in a manner which is, per se, well known.

The riser pipe 34 functions both to serve as a housing and outer seat for the sealing ring 38 and as a more traditional pipe for directing liquid in the container 26 into the upper portions of the valve assembly 20 from the lower portions of the container. The riser pipe 34 is stepped so as to present a lower portion 48 of relatively narrow diameter separated from an upper portion 50 of relatively large diameter by a shoulder. Upper portion 50 surrounds the chamber 40 and slidably receives and guides the sealing ring 38. An outwardly radially extending flange 52 is formed on the upper end of the riser pipe 34 and is clamped between the shoulder 28 of the stub 22 and the bottom end of the housing 32 with the aid of upper and lower sealing rings or gaskets 54 and 56. A plurality of circumferentially-spaced ingress/egress portals or openings 58 are formed in the upper portion 50 of the riser pipe 34 at a location beneath the flange 52.

The purpose of the dispensing tower 36 is to provide a pathway for flow of liquid or gas (depending upon the operational state of the valve assembly) out of the container 26, to guide the inner periphery of the sealing ring 38 during axial movement thereof, and to cooperate with the sealing ring 38 to selectively prevent and permit fluid flow from the container 26. The dispensing tower 36 is sealed at its upper end by a cap 60 preferably formed integrally with the tubular tower. The lower end of the dispensing tower 36 is open and presents an outwardly extending radial flange 62 which normally rests on the shoulder of the riser pipe 34. Triangular projections 64 are punched upwardly from the flange 62. Projections 64 radially center the spring 44 and prevent excessive radial movement of the bottom end of the spring 44. A plurality of openings 66 are formed in the flange 62 when the projections 64 are punched. The openings 66 assure free flow of fluid between the annular chamber 40 and the interior of the riser pipe 34. In addition, a plurality of circumferentially spaced discharge openings or portals 68 are formed through the wall of the dispensing tower 36 near its upper end.

The sealing ring 38 performs two functions. First, it serves as a valve element, selectively opening and closing the portals 58 and 68 and exposing them to various fluids, i.e., either a gas or a liquid. Secondly, it guides the dispensing tower 36 and maintains the perpendicularity and eccentricity between the sealing ring 38, the dispensing tower 36, and the riser pipe 34, thereby enhancing sealing. The sealing ring 38 could conceivably be formed entirely out of rubber or another polymeric material but, in the illustrated embodiment (FIG. 2), is formed from an inner, rigid, thermally degradable, insert 70 surrounded by a layer 72 of a molded polymeric material such as synthetic or natural rubber.

The outer portion of the upper end of the sealing ring 38 presents a chamfer 74 which complements the shape of the retaining ring 46 of housing 32. Chamfer 74 seals against retaining ring 46 when the sealing ring 38 is in its uppermost position illustrated in FIG. 2. The inner radial portion of the upper end surface of the sealing ring 38 presents a flat sealing face 76 for contact with a spindle as detailed below. A first circular sealing lip 78 extends radially outwardly from the outer periphery of the sealing ring 38 and engages and seals against the internal surface of the riser pipe 34.

The first sealing lip 78 is generally V-shaped and includes an upper sealing surface 80 and a lower sealing surface 82 both of which engage the internal surface of the riser pipe 34 and between which is formed an annular space that reduces contact friction and make the sealing lip very pliant. This can be enhanced with very slender annular face rib(s) on sealing surface 80 and 82 (not present in this embodiment). This generally V-shaped configuration of the lip 78 (1) provides bi-directional sealing at very low pressure, preventing fluid from flowing past the lip 78 either from above or below and (2) facilitates initial movement of the sealing ring 38 within the riser pipe 34 and prevents damage or abrasion of the sealing ring 38. A second circular V-shaped lip 84 extends radially inwardly from the inner peripheral surface of the sealing ring 38 and is positioned above the discharge portals or openings 68 when the valve assembly 20 is in its neutral or closed position illustrated in FIG. 2.

Finally, a plurality of frustoconical centering projections 86 extend radially from the sealing ring 38. These projections 86 could extend from the inner peripheral surface of the sealing ring 38 as illustrated, from the outer peripheral surface, or from both. They also could be supplemented or replaced by diagonal, and/or spiral, or vertical ribs (not present in this embodiment). These projections 86 guide and stabilize the sealing ring 38 with respect to the member they contact (the dispensing tower 36 in the illustrated embodiment) while maintaining the eccentricity of these elements and permitting the free-flow of fluid past the projections 86. The illustrated projections 86 are formed integrally with the polymeric layer 72, but it is conceivable that they could be formed from a separate structure or even from projections of the insert 70 extending through the polymeric layer 72.

Figure 2:
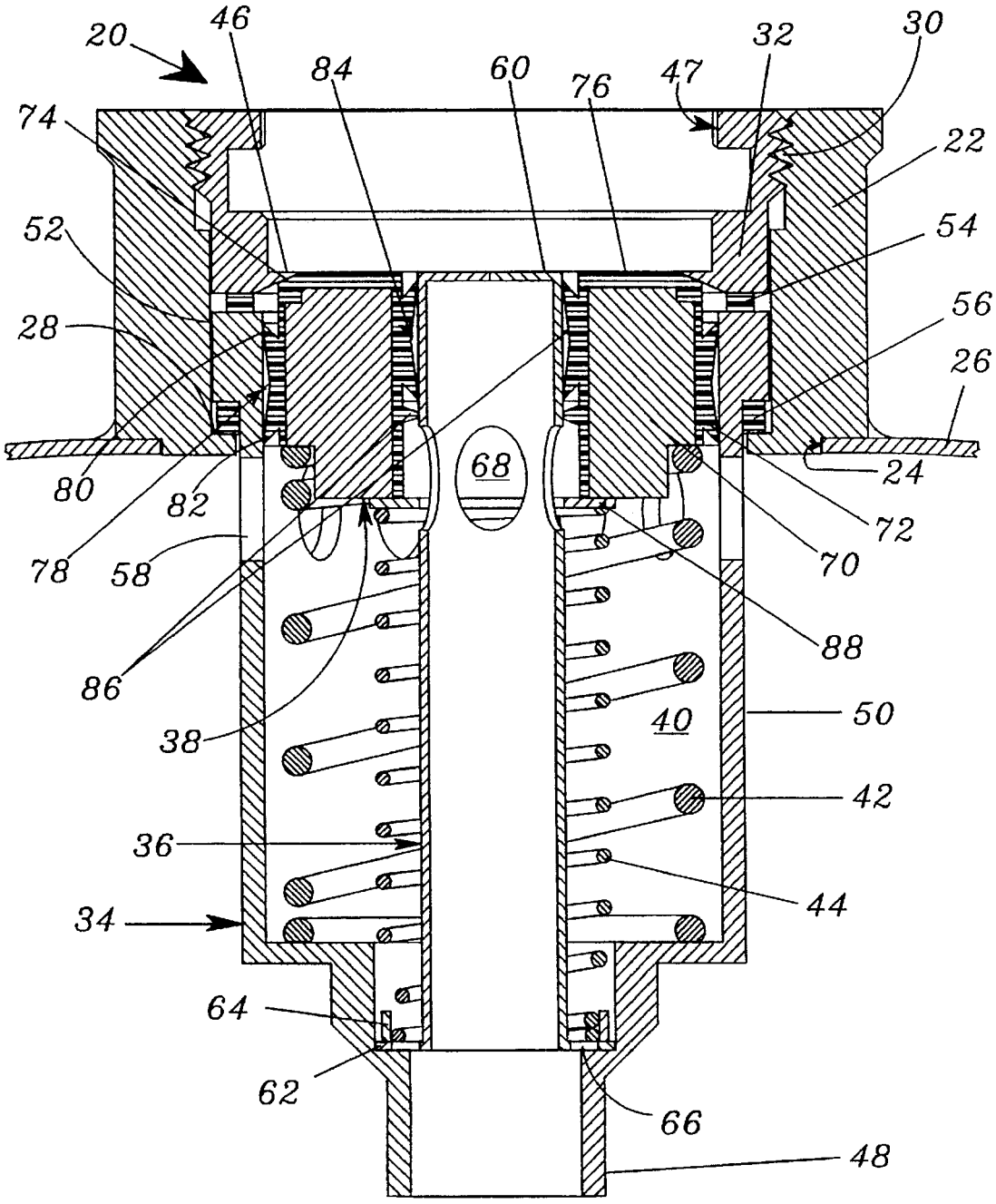
FIG. 2 is a sectional elevation view of the valve assembly of FIG. 1 and illustrating the valve assembly in its neutral or closed mode.

Sealing ring 38 is biased into its uppermost position illustrated in FIG. 2 both by the first or sealing spring 42 and the second or vent spring 44. The sealing spring 42 is seated against the bottom surface of the insert 70 at its upper end and against a step in the riser pipe 34 at its upper end. The second or vent spring 44 is seated at its lower end against the flange 62 of the dispensing tower 36 and at its upper end against a spacer 88 positioned between the spring 44 and the bottom surface of the polymeric layer 72.

Figure 3:
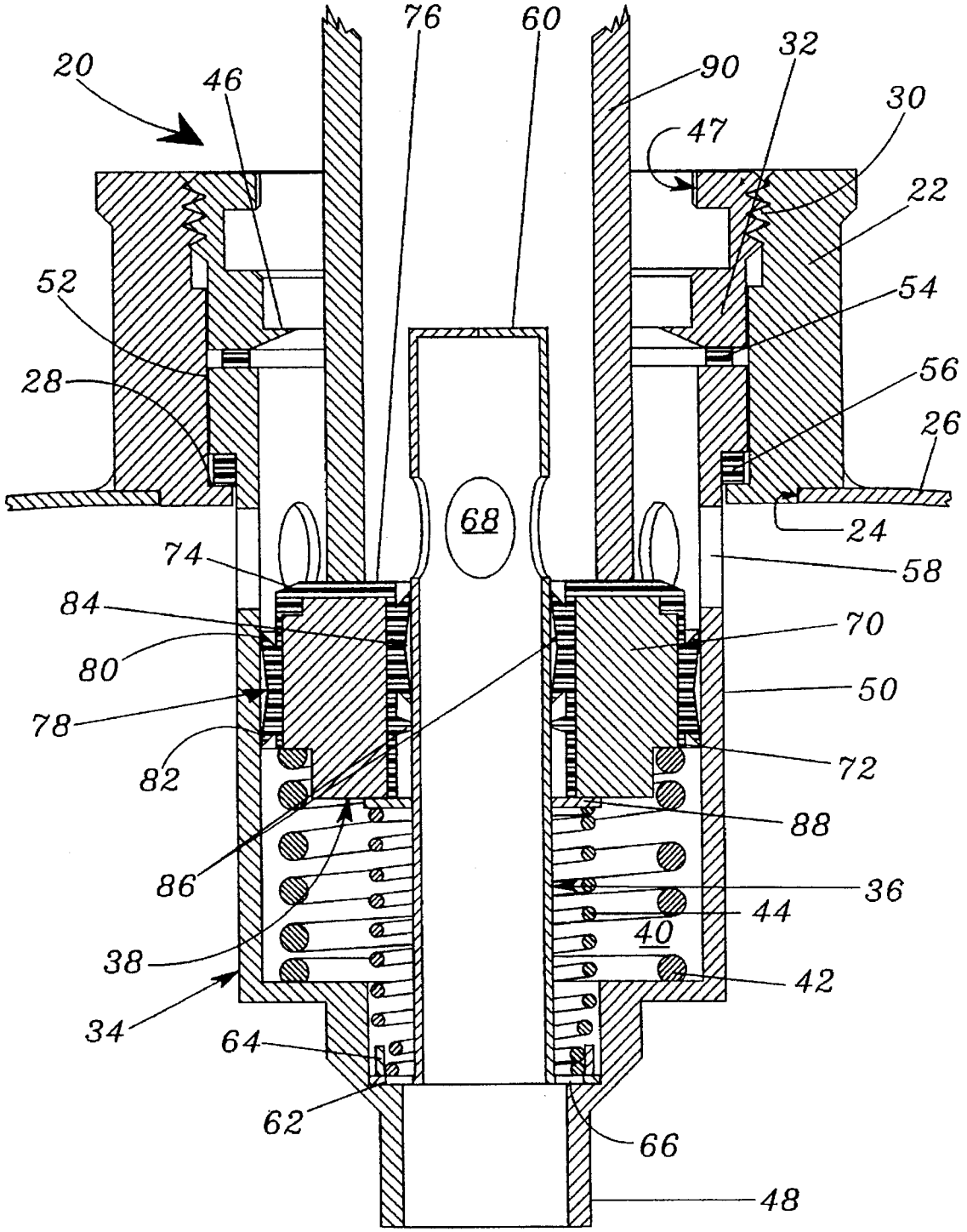
FIG. 3 is a sectional elevation view of the valve assembly of FIGS. 1 and 2 and illustrating the valve assembly in its normal or working mode.
Figure 4:
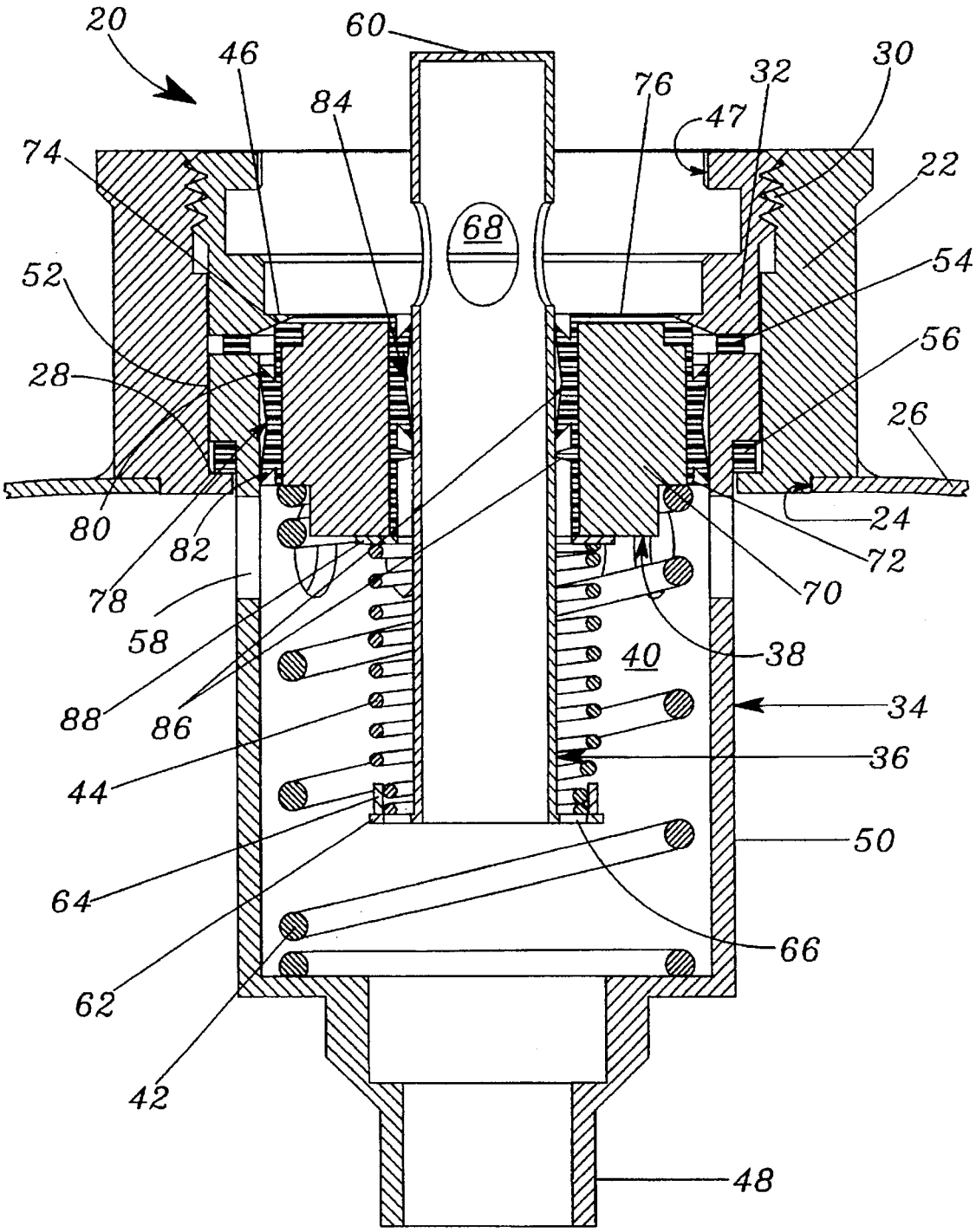
FIG. 4 is a sectional elevation view of the valve assembly of FIGS. 1–3 and illustrating the valve assembly in its pressure release or venting mode.
Figure 5:
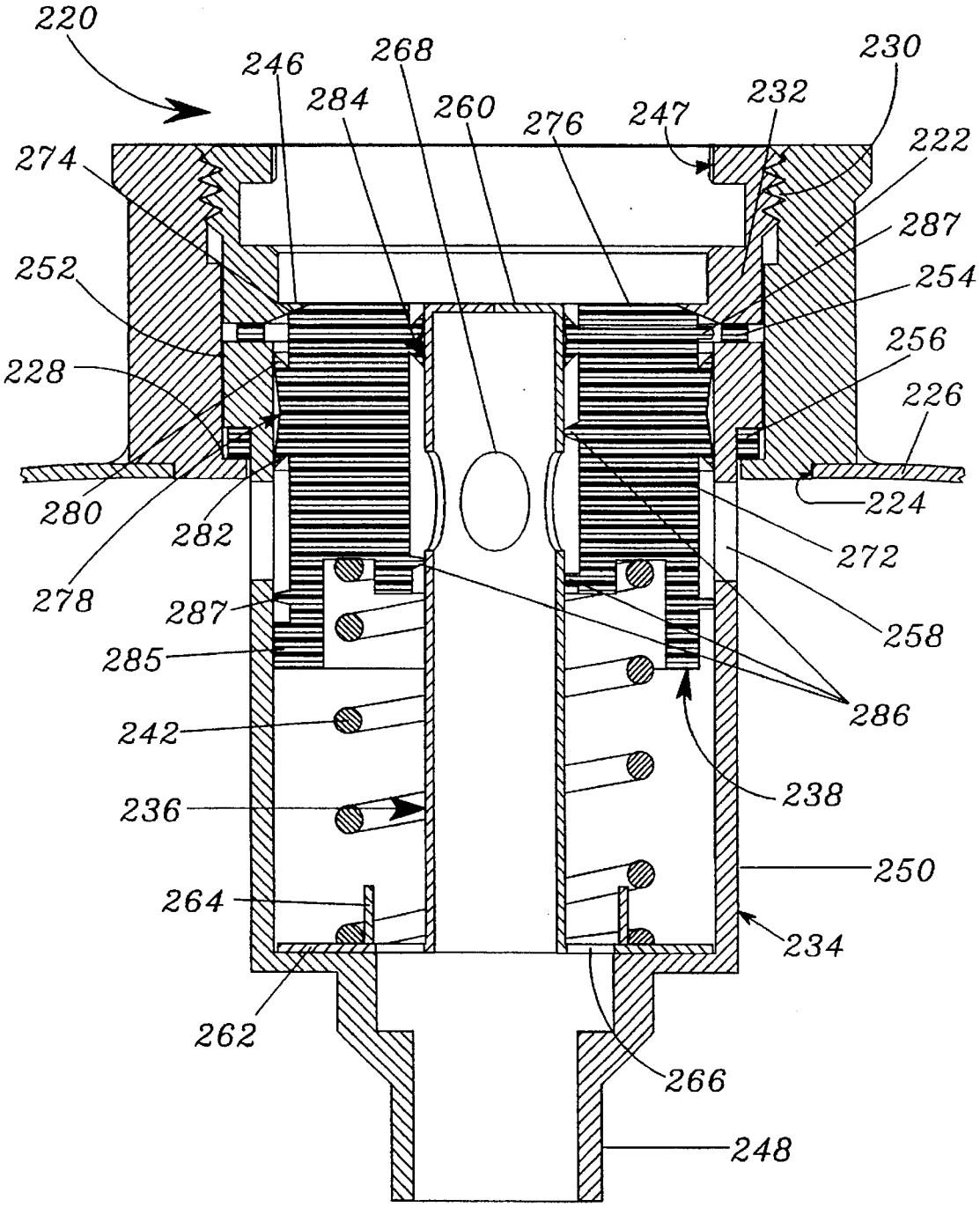
FIG. 5 is a sectional elevation view of a valve assembly according to a second embodiment of the invention and showing the valve assembly in its neutral or closed mode.

There are three modes of operation associated with the valve assembly 20 illustrated in FIGS. 1–4, namely: (1) neutral/closed (FIG. 2), (2) working/open to gas ingress and liquid egress (FIG. 3), and (3) venting/relieving excess pressure from within the container 26 (FIG. 4). A detailed discussion of each follows.

The neutral or closed position of the valve assembly 20 is illustrated in FIG. 2. The outer sealing lip 78 of the sealing ring 38 seals against the riser pipe 34 at a location above ingress/egress openings or portals 58, and the inner sealing lip 84 seals against the dispensing tower 36 at a location above the discharge portals 68. The chamfer 74 is held against the ring 46 of the housing 32 by the combined force of springs 42 and 44 and spacer 88. The arrangement of the members in this operational state differs from known assemblies in that the ingress/egress portals 58 and the discharge portals 68 share the same gas pressure, present throughout chamber 40 due to gas flow among the conical projections 86, thereby allowing the liquid in container 26 to seek its own level away from portals 58 and 68 via the inlet of the riser pipe 34. This in turn improves the coupling safety when a coupling arrangement is attached to the valve assembly 20.

Turning now to FIG. 3, the valve assembly 20 is placed in its second mode of operation in which it is open to gas ingress and liquid egress. Sealing ring 38 has been forced downwardly by a conventional fixed external coupling arrangement such as the arrangement manufactured by Perlick and marketed as Model No. MK-1. The conventional coupling arrangement includes an internal, axially displaceable, hollow spindle 90 which, when pressed downward, contacts the upper sealing face 76 of the sealing ring 38 (the ID of the spindle 90 being bored slightly if necessary to accommodate the present invention. In addition, an internal radially-extending riser stop and a separate internal V-shaped seal can if desired be added to the spindle) and forces the sealing ring 38 downwardly from the position illustrated in FIG. 2 to the position illustrated in FIG. 3. Coupling of the spindle 90 to the sealing face 76 creates (1) an ingress tube in the region located radially outside of the spindle 90 for flow of the propellant gas into the container 26, and (2) an egress tube within the spindle 90 for the flow liquid out of the container 26. The integrity of the gas and liquid separation at the circular line of contact between the spindle 90 and the sealing face 76 of the sealing ring 38 is maintained by the upward pressure of sealing spring 42. Seal integrity is enhanced further by the conical projections 86 and/or vertical ribs (not shown) fixed on the I.D. and/or O.D. walls of the sealing ring 38. As discussed above, these projections 86 serve to guide and stabilize the perpendicularity and eccentricity between the sealing ring 38, dispensing tower 36, and riser pipe 34, thereby enhancing the sealing of the outer and inner sealing lips 78 and 84 of the sealing ring 38 as they move downwardly past the ingress/egress openings or portals 58 of riser pipe 34 and the discharge openings or portals 68 of dispensing tower 36, respectively.

It is important to note that the sequence of portal overlap and exposure is timeable by setting differential relationships between the sealing lip and portal locations during valve manufacture. The valve assembly 20 therefore can be readily modified to allow the valve assembly 20 to mix more then one liquid or gas in the same chamber 40, with the differential between them being controllable by design.

When the sealing ring 38 is forced downwardly to the position illustrated in FIG. 3, (1) the ingress/egress portals 58 are exposed to propellent gas flowing into the valve assembly 20 from the region surrounding the spindle 90, and (2) the discharge portals 68 are exposed to the internal fluid discharge passage of the spindle 90. Outer sealing lip 78 prevents the propellant gas from entering the liquid at a location just below portals 58. Sealing lip 78 therefore preserves ingress propellant pressure integrity as the gas flows into the container 26. In addition, the sealing lip 78 prevents liquid from entering the ingress/egress portals 58 and thus closes the riser pipe being off to its gas connection. This in turn forces the gas now entering the container 26 through the ingress/egress portals 58 to push the liquid up into the lower inlet of the riser pipe 34, up through the center of dispensing tower 36, and out of the dispensing tower 36 through the discharge portals 68. The discharged liquid then flows through the spindle 90 and is dispensed from the system in a conventional manner.

Conversely, when there is no external coupling attached to valve assembly 20, springs 42 and 44 return the sealing ring 38 to its neutral or closed mode as illustrated in FIG. 2, thereby containing liquid and gas within container 26 for transport. The inventive valve assembly 20 therefore exhibits the same benefit as previously-known valve assemblies which also contain liquid and gas within their containers for transport when they are closed.

However, unlike conventional valve assemblies, the inventive valve assembly 20 also is capable of operating in a pressure relief mode. Pressure relief is desirable because the contents of the container 26 can be exposed to thermal agitation such as fire or mechanical agitation such as excessive shaking. External agitation may cause gas pressure within the container 26 to build-up to a level that is high enough to breach the container's integrity with devastating consequences. This potential overpressurization is avoided by permitting the valve assembly 20 to assume the mode illustrated in FIG. 4 in which pent-up gas pressure within the container 26 overcomes the seal between the inner sealing lip 84 of the sealing ring 38 and the dispensing tower 36. That is, gas pressure acting on the dispensing tower 36 forces the tower 36 upwardly against the force of the spring 44 to a position where portals 68 vent. Since the sealing ring 38 is held from upward movement by the ring 46 of the housing 32, the discharge or egress portals 68 of the discharge tower 36 move beyond the inner sealing lip 84 to permit excess pressure within the container to flow past the riser pipe 34, through ingress/egress portals 58, through the dispensing tower 36, and out of the valve assembly 20 through the discharge portals 68. It should be noted that, because upward movement of the dispensing tower 36 is resisted primarily by the spring 44, the threshold pressure above which relief or venting occurs is determined by the strength of the spring 44 and can be set by selecting a spring of a designated strength. In those instances in which overpressurization results from thermal agitation caused by fire or the like, pressure release can be accelerated through thermal degradation of the insert 70 and consequent ejection of the entire sealing ring 38 from the valve assembly 20.

The valve assembly could take many forms from that illustrated and described above without departing from the basic principals of operation. A first alternative construction of the inventive valve assembly will now be described.

3. Description of Second Embodiment

Referring to FIGS. 5–8, components of the valve assembly 220 of the second embodiment corresponding to components of the valve assembly 20 of the first embodiment (illustrated in FIGS. 1–4) are designated by the same reference numerals, incremented by 200. The valve assembly 220 of FIGS. 5–8 differs from the valve assembly 20 of FIGS. 1–4 in that (1) the sealing ring 238 is of slightly different design, (2) one of the springs of the first embodiment has been eliminated, and (3) dispensing tower 236 has been redesigned to accommodate the elimination of one of the springs. These discrepancies from the first embodiment will now be detailed.

Sealing ring 238 is configured for sliding movement in the chamber 240 in the same manner as the sealing ring 38 of the first embodiment. However, this sealing ring 238, unlike the sealing ring 38 of the first embodiment, is formed of a single unitary polymer member and thus lacks the rigidifying insert of the first embodiment. Additional centering projections 287 also are provided on the outer radial periphery of a sealing ring 238, and vertical centering ribs 285 are provided on the outer radial periphery to help guide the sealing ring 238 as it moves along the riser pipe 234.

The sole spring 242 of the second embodiment is designed to interact with the elastomeric sealing ring 238 to perform the combined functions of both springs 42 and 44 of the first embodiment. The spring 242 urges against the bottom surface of the sealing ring 238 at its upper end and against the annular flange 262 of the dispensing tower 236 at its lower end. The generally triangular projections 264 of this flange 262 are spaced further towards the inner edge of the flange 262 when compared to the corresponding projections 64 of the first embodiment to accommodate the larger spring. Finally, the relative positional relationship between the sealing lips 278 and 284, the ingress/egress openings or portals 258, and the discharge openings or portals 268 has been varied slightly to accommodate the revised sealing ring configuration.

Operation of the valve assembly 220 of the second embodiment is essentially identical to the operation of the valve assembly 20 of the first embodiment. Hence, when the valve assembly 220 is in its neutral closed mode illustrated in FIG. 5, the outer sealing lip 278 is located above the ingress/egress portals 258 and sealed against the internal surface of the riser pipe 234, the inner sealing lip 284 is located above the discharge portals 268 and sealed against the external surface of the dispensing tower 236, and the chamfer 274 is sealed against the ring 246. Accordingly, the entire portion of the chamber 240 beneath the sealing ring 238 is subject to whatever gas pressure exists within the container 226, and egress of fluids from the dispensing tower 236 is prohibited by the inner sealing lip 284.

Figure 6:
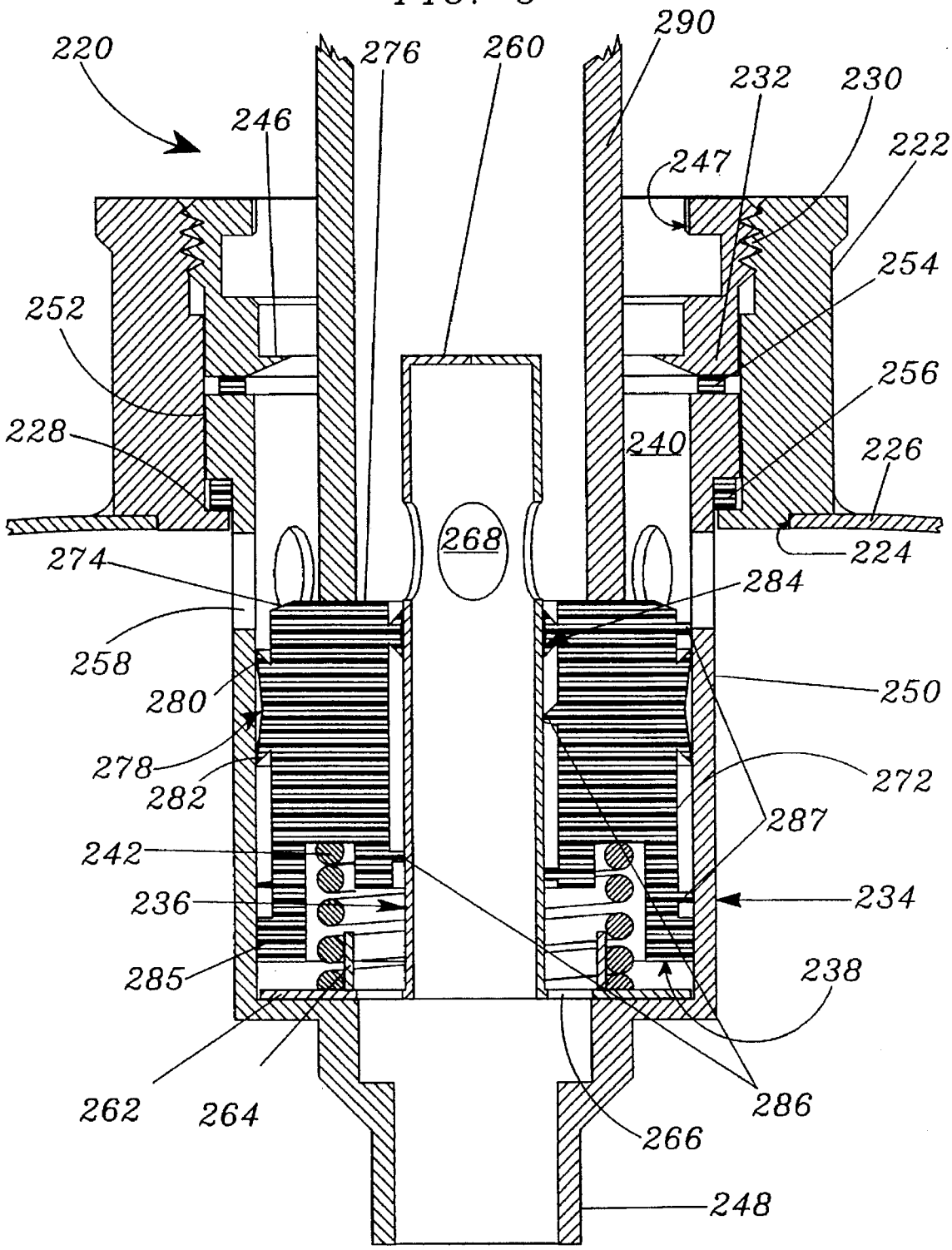
FIG. 6 is a sectional elevation view of the valve assembly of FIG. 5 and illustrating the valve assembly in its normal or working mode.

In the working mode, shown in FIG. 6, the sealing ring 238 of the second embodiment is forced downwardly by a hollow spindle 290 against spring 242 to the illustrated position in which the outer and inner sealing lips 278 and 284 are positioned beneath the respective rows of portals 258 and 268. The integrity of the gas and liquid separation at the interface between the spindle 290 and the sealing face 276 is maintained by the upward pressure of spring 242. The inner and outer conical projections 286 and 287 and/or vertical ribs 285, fixed on the I.D. and/or O.D. walls of sealing ring 238, guide and stabilize the perpendicularity and eccentricity between the sealing ring 238, the dispensing tower 236, and the riser pipe 234, thereby enhancing the sealing of the lips 278 and 284 as they move downwardly past the discharge portals 268 of dispensing tower 236 and the ingress/egress portals 258 of riser pipe 234. As in the first embodiment, the sequence of portal blockage and opening is timeable by setting or altering the differential relationships between the sealing lip and portal locations. The operation of the valve assembly 220 in its working mode is otherwise the same as the operation of the valve assembly 20 of the first embodiment in its working mode and, accordingly, will not be detailed.

Figure 7:
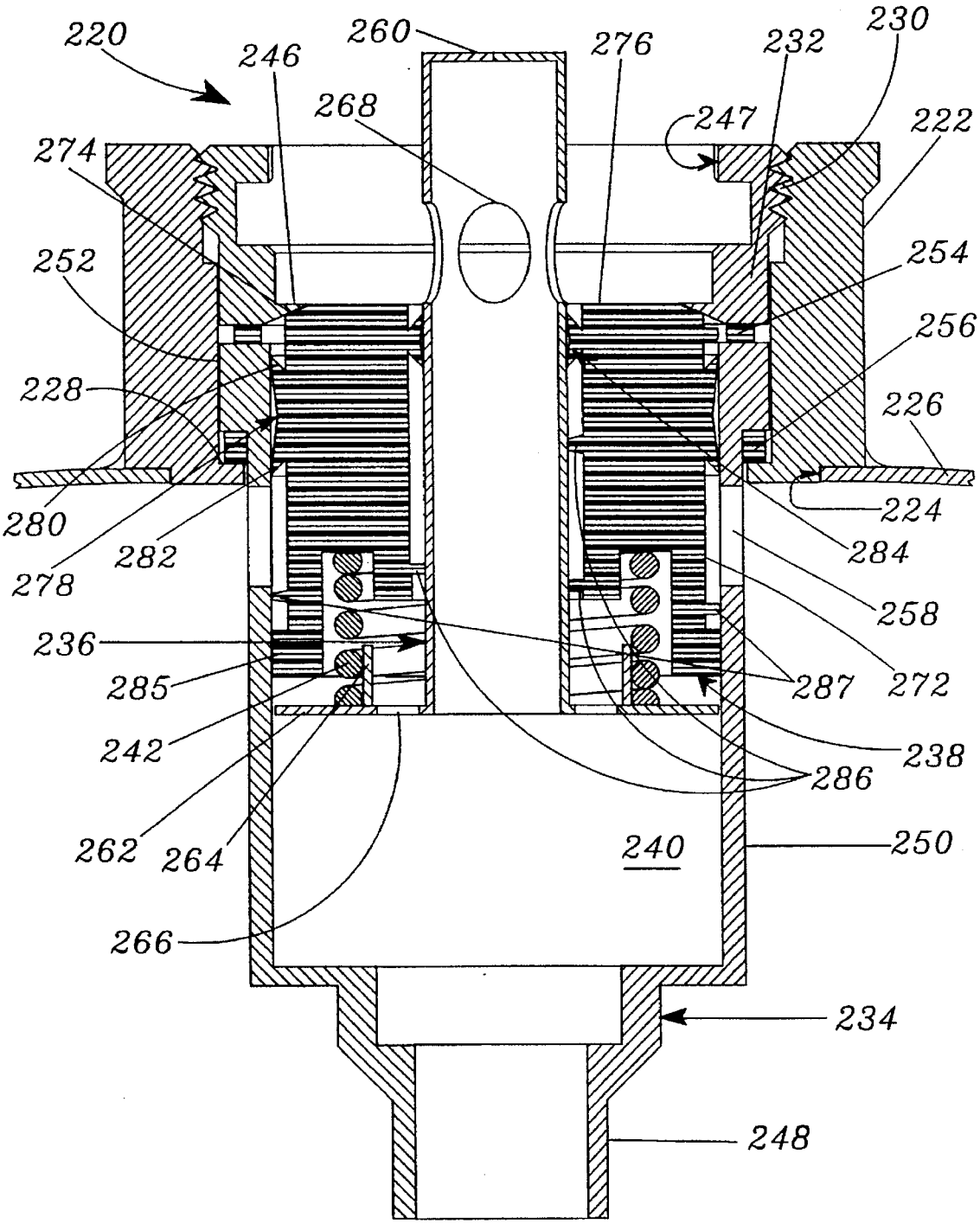
FIG. 7 is a sectional elevation view of the valve assembly of FIGS. 5 and 6 and illustrating the valve assembly in its pressure release or venting mode.
Figure 8:
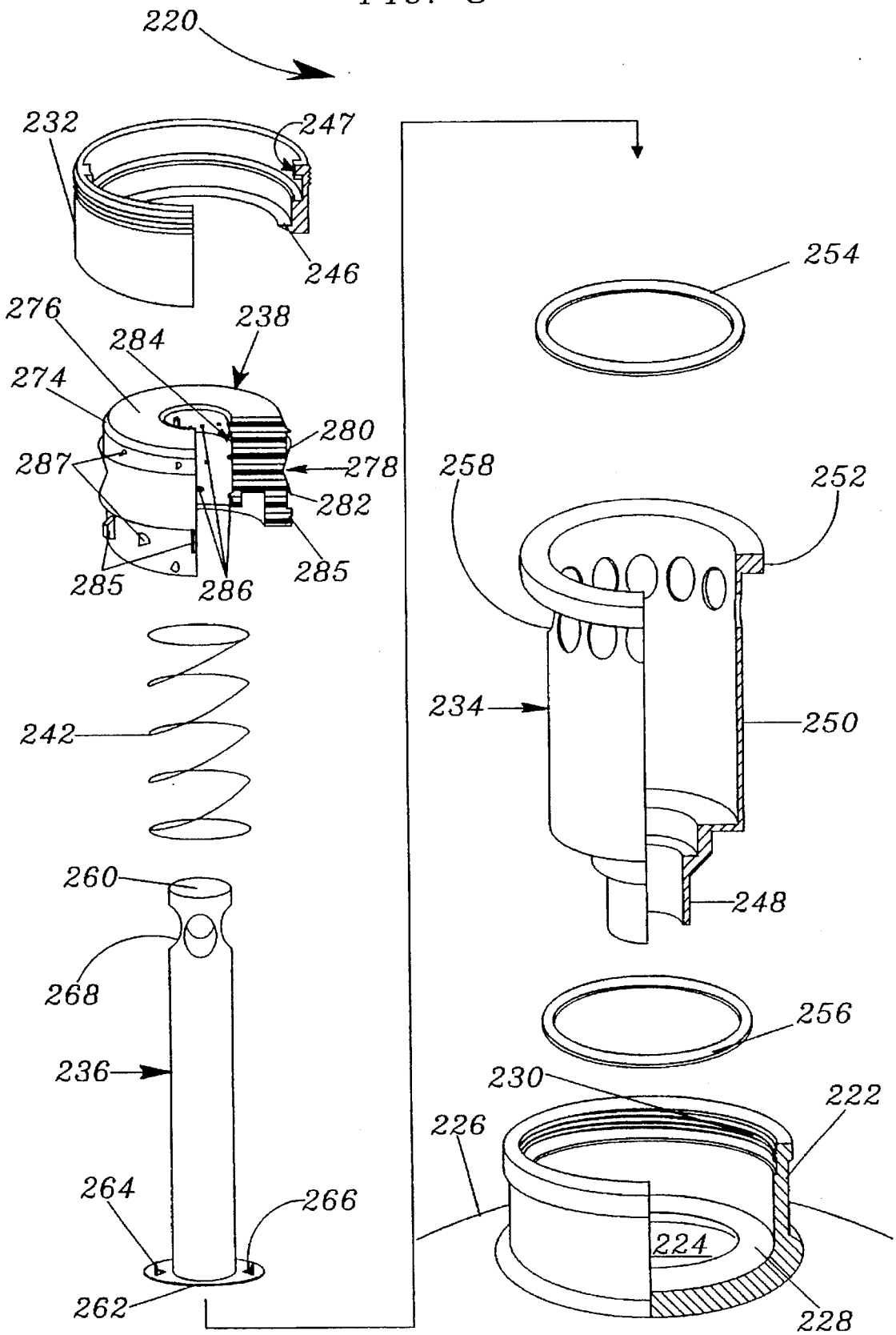
FIG. 8 is an exploded perspective view of the valve assembly of FIGS. 5–7.

Conversely, when, as illustrated in FIG. 7, there is no external coupling attached to the valve assembly 220, the sole spring 242 of the assembly returns the sealing ring 238 to its neutral or closed state, thereby containing liquid and gas within the container 226 for transport. However, if the contents of the container 226 become overpressurized due, e.g., to thermal agitation, the excess pent-up pressure will force dispensing tower 236 upwardly against the force of control spring 242 to the illustrated position venting said pressure through discharge portals 268 which are now located above the inner sealing lip 284 of the sealing ring 238, in the same manner detailed above in connection with the first embodiment.

4. Description of Third Embodiment

Turning now to FIGS. 9–12, a valve assembly 320 constructed in accordance with a third embodiment of the invention is illustrated which is similar to the valve assembly 220 of the second embodiment. Components of the third embodiment corresponding to those of the second embodiment are, accordingly, designated by the same reference numerals, incremented by 100.

The valve assembly 320 of the third embodiment differs from the valve assembly 220 of the second embodiment primarily in that the dispensing tower 336 takes the form of an imperforate standpipe assembly rather than a perforated hollow pipe. The dispensing tower 336 therefore includes an upper head 361 of relatively large diameter and a lower shank 363 of relatively small diameter separated by a downwardly facing shoulder 369 on the head 361. An annular plate 362 is affixed to the bottom end portion of the shank 363 and serves the same function as the annular flange 262 of the second embodiment, namely, it supports the spring 342 and has projections 364 bent upwardly therefrom to guide the spring 342 and to form opening 366 for fluid flow through the plate 362. Ribs 385 are shown as being mounted on the shank 363 rather than the sealing ring 338 to illustrate that centering devices could be mounted on either or both members.

The sealing ring 338 of the third embodiment differs from the sealing ring 238 of the second embodiment in that its inner portion is modified to cooperate with the standpipe or dispensing tower 336. Specifically, as is clearly illustrated in the drawings, the inner peripheral surface of the sealing ring 338 is stepped so as to present an axial shoulder or sealing face 377 on which mating shoulder 369 of the dispensing tower 336 sealingly rests when the valve assembly 320 is in its neutral or closed mode illustrated in FIG. 9. In the other two modes of operation, illustrated in FIGS. 10 and 11, respectively, sealing face 377 is spaced from the shoulder 369 of the dispensing tower 336 to permit fluid flow therepast and out of the valve assembly 320.

The operation of the valve assembly 320 of the third embodiment is generally the same as the operation of the valve assembly 220 of the second embodiment. The sealing ring 338 moves downwardly within the chamber 340, under the action of a spindle 390 of a coupling head and against the biasing force of the spring 342, from its neutral or closed position illustrated in FIG. 9 to its working or open position illustrated in FIG. 10. The integrity of the gas and liquid separation at the spindle-to-sealing ring coupling is maintained before and after this motion by the upward pressure of control spring 342 and by conical projections 386 and 387 and/or vertical ribs 385, which help stabilize the perpendicularity and eccentricity between the sealing ring 338, dispensing tower 336, and riser pipe 334, thereby enhancing the sealing of the sealing lip 378 as the sealing ring 338 moves downwardly past the ingress/egress portals 358 of the riser pipe 334. Movement of the sealing ring 338 relative to the dispensing tower 336 causes the sealing face 377 of the sealing ring 338 to separate from the mating shoulder 369 on the dispensing tower 336, thereby permitting liquid to flow between the sealing ring 338 and the dispensing tower 336, out of the valve assembly 320, and into the egress tube formed by the spindle 390. As in the previous embodiments, this is a sequence that is timeable by altering the differential relationships between the sealing lip and portal and shoulder locations. The operation of the valve assembly 320 in its working mode is otherwise the same as in the first and second embodiments and, accordingly, will not be detailed.

Figure 9:
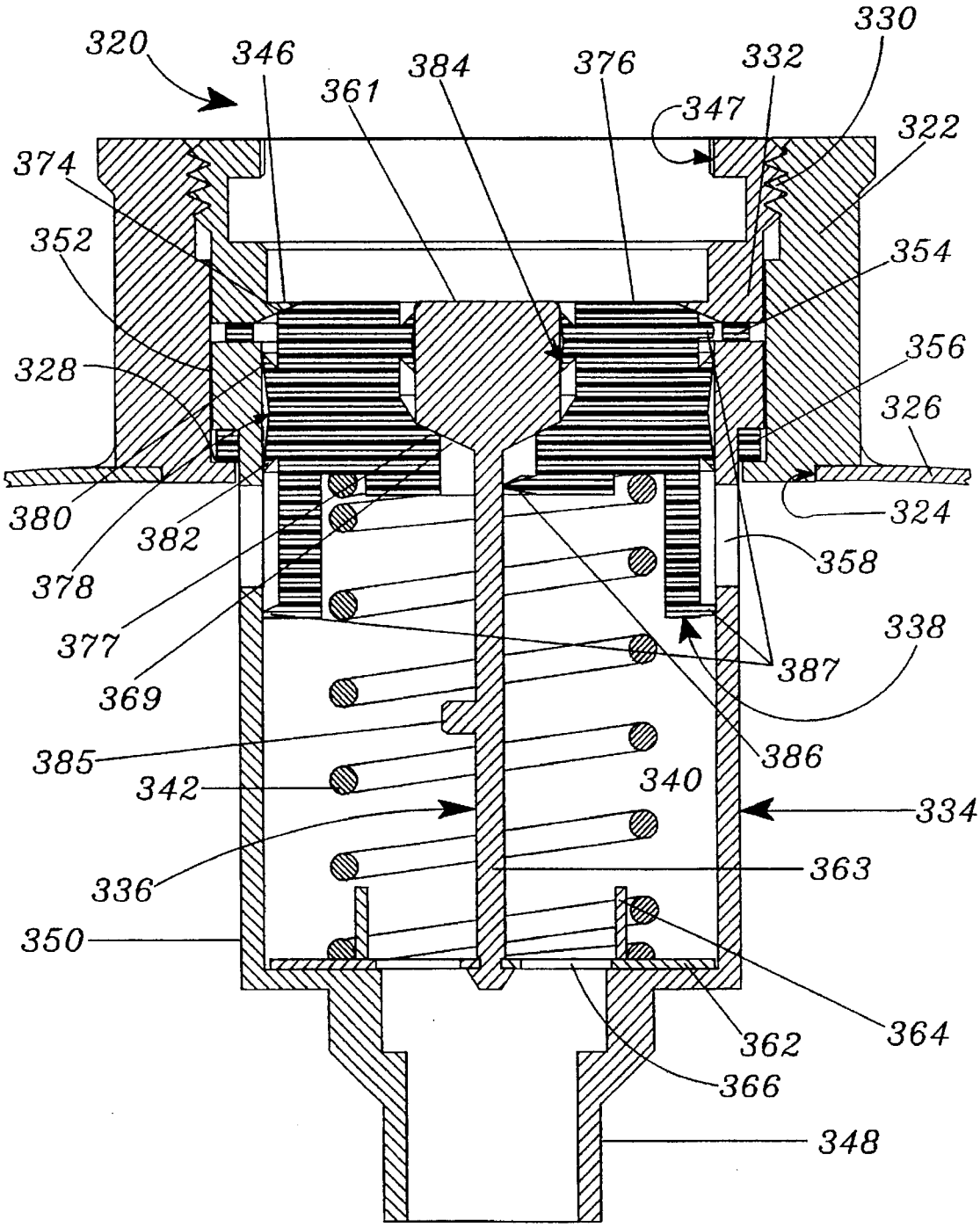
FIG. 9 is a sectional elevation view of a valve assembly according to a third embodiment of the invention and showing the valve assembly in its neutral or closed mode.
Figure 10:
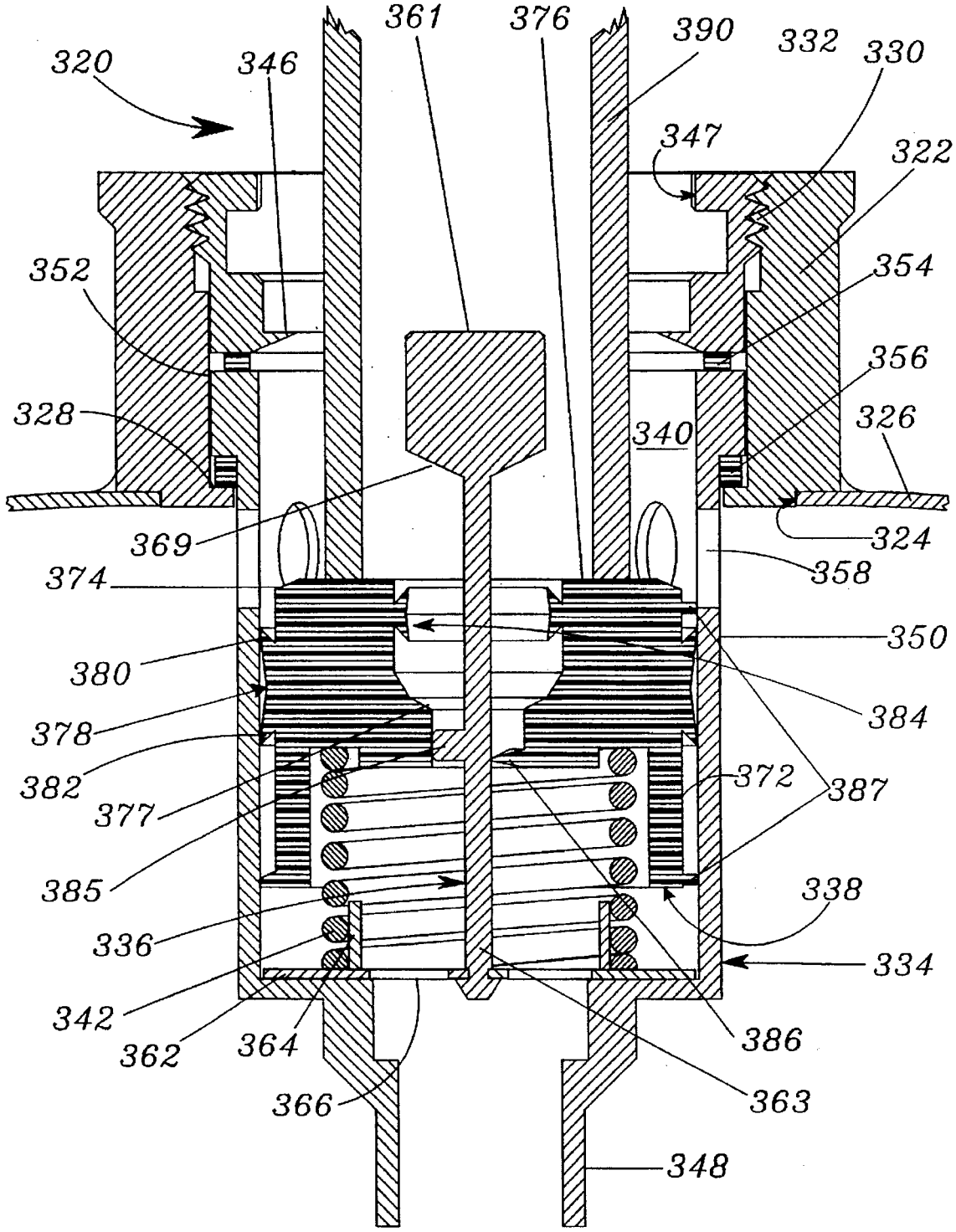
FIG. 10 is a sectional elevation view of the valve assembly of FIG. 9 and showing the valve assembly in its normal or working mode.
Figure 11:
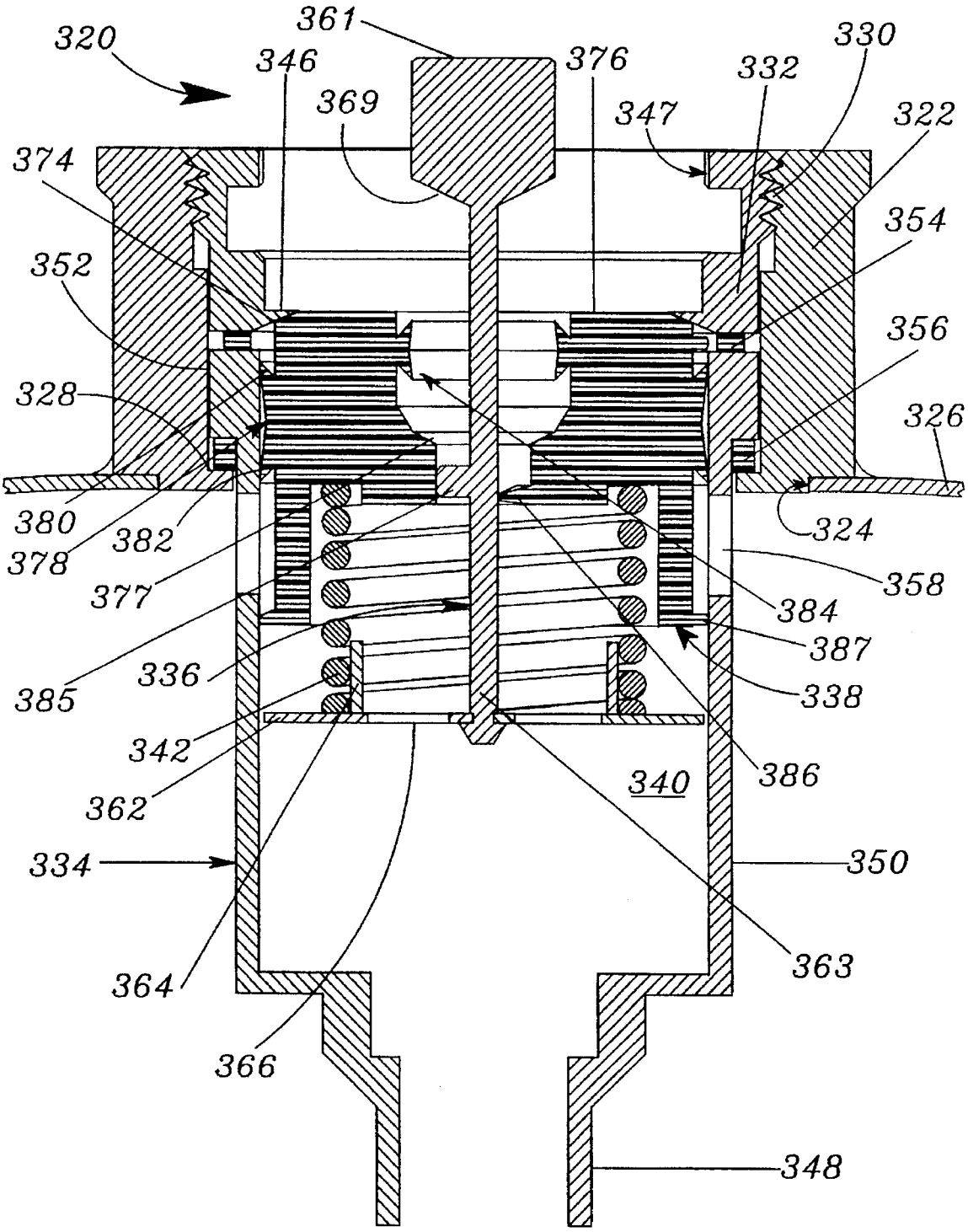
FIG. 11 is a sectional elevation view of the valve assembly of FIGS. 9 and 10 and showing the assembly in its pressure release or venting mode.
Figure 12:
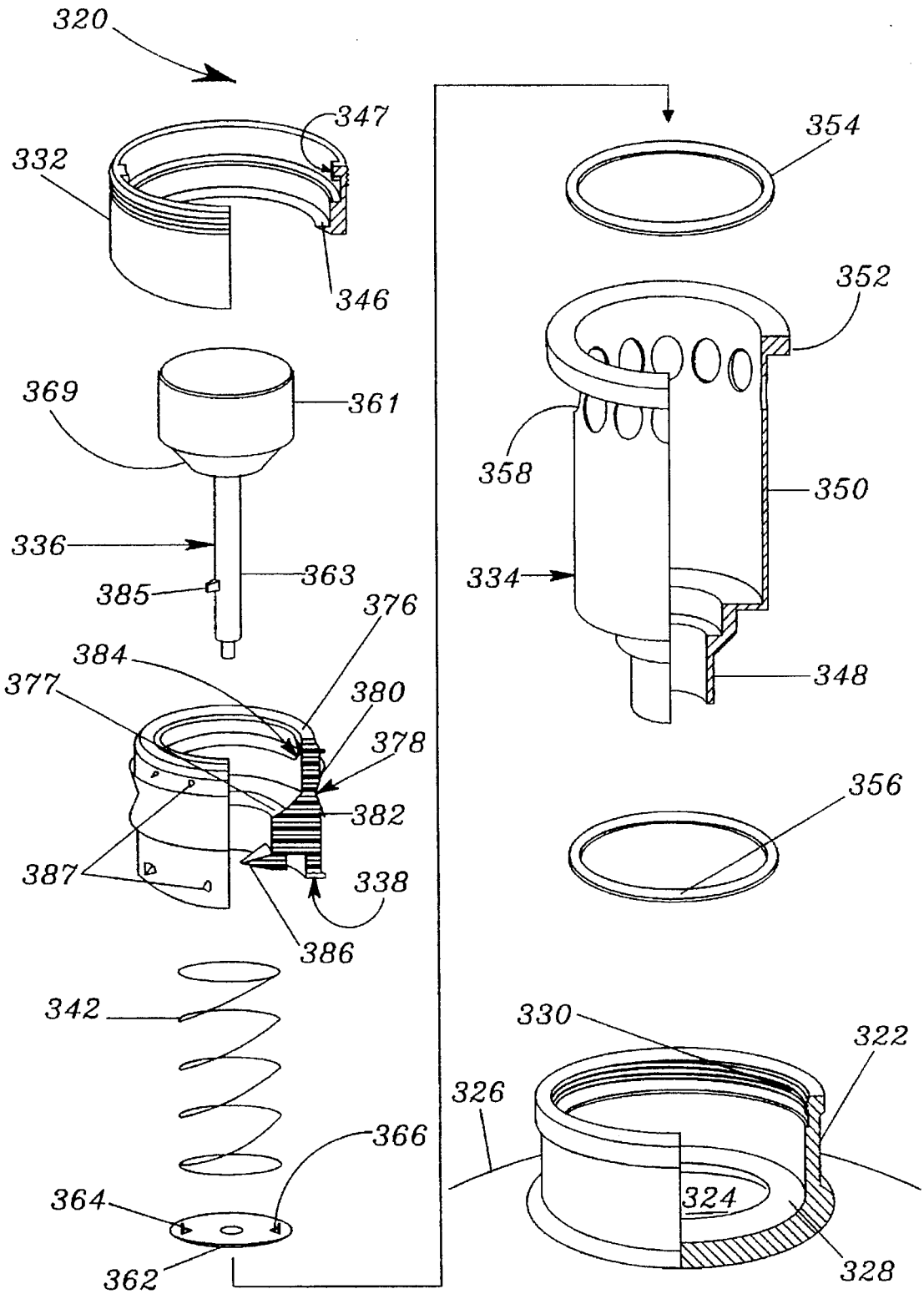
FIG. 12 is a exploded perspective view of the valve assembly of FIGS. 9–11.

When, as illustrated in FIGS. 9 and 11, there is no external coupling attached to valve assembly 320, spring 342 returns the sealing ring 338 to its neutral or closed state, thereby containing liquid and gas within container 326 for transport. In the event of pressure build-up within the container 326 due to the imposition of thermal or mechanical agitation, excess pressure in the container 326 will force the dispensing tower 336 upwardly, against the biasing force of control spring 342, so that the bottom horizontal plane or shoulder 369 of the large diameter or head 361 of the standpipe or dispensing tower 336 moves past the horizontal plane or sealing face 377 of the sealing ring 338. The pressurized gas in the container 326 is then free to vent through the ingress/egress portals 358 of riser pipe 334, then through the center of the sealing ring 338, past the open egress pathway between the sealing ring 338 and the dispensing tower 336, and out of the valve assembly 320.

5. Description of Fourth Embodiment

Still another embodiment of the invention is illustrated in FIGS. 13–16. The valve assembly 420 constructed in accordance with this fourth embodiment differs from the valve assembly 20 of the first embodiment primarily in that, in a pressure relief or venting mode, the dispensing tower 436 is held stationary and the sealing ring 438 moves upwardly to achieve the desired venting. Several relatively minor structural changes are made to the valve assembly 420 to permit this alternate operation. However, the valve assembly 420 of this embodiment is for the most part similar in construction and operation to the valve assembly 20 of the first embodiment. Components of this embodiment corresponding to components of the first embodiment are, accordingly, designated by the same reference numerals, incremented by 400. Those features which are altered with respect to the first embodiment will now be detailed.

Figure 13:
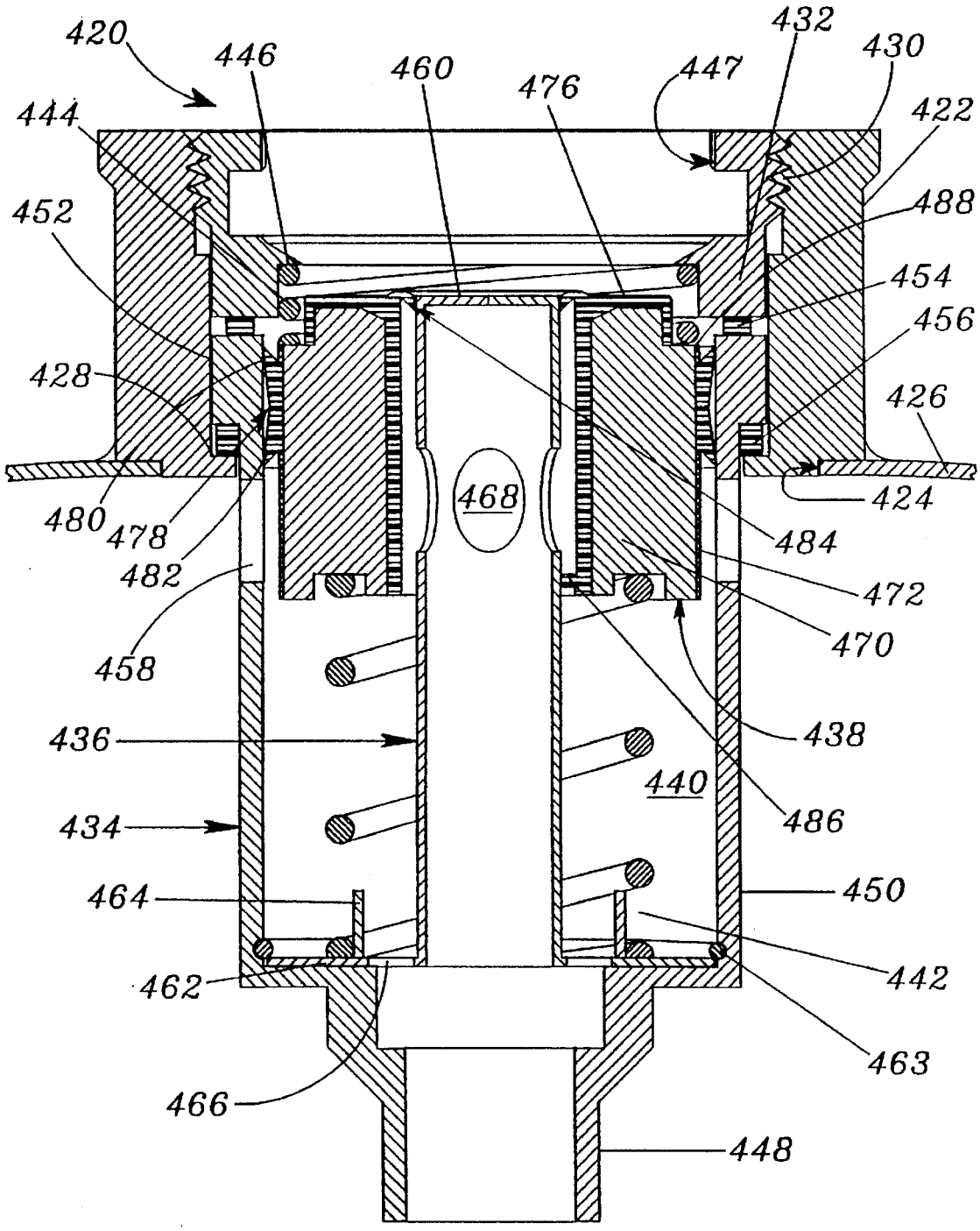
FIG. 13 is a sectional elevation view of a valve assembly according to a fourth embodiment of the invention and showing the valve assembly in its neutral or closed mode.

First, the sealing ring 438 does not engage the ring 446 of the housing 432 when the valve assembly 420 is in its neutral or closed position illustrated in FIG. 13. Rather, the sealing ring 438 is held in a neutral position in which it is spaced between the housing ring 446 and the ingress/egress portals 458 of the riser pipe 434 under the balancing action of the lower or sealing spring 442 and a second, venting spring 444 located above the sealing ring 438 and acting against the sealing spring 442. The venting spring 444 is positioned axially between the housing ring 446 and the sealing ring 438 and is configured to apply a downward biasing force on the sealing ring. Contact between an intermediate axial portion of the sealing ring and the spring 444 is made possible by configuring the sealing ring 438 such that it is somewhat longer than the sealing ring 38 of the first embodiment and such that it has a stepped outer peripheral surface so as to present an upwardly facing shoulder 488 on which the spring 444 rests.

Second, the bottom flange or ring 462 of the dispensing tower 436 is larger in diameter than the flange or ring of the first embodiment and is held in its illustrated position by a retaining ring 463 mounted in the riser pipe 434, and/or protrusions within riser pipe 434.

The operation of the valve assembly 420 constructed in accordance with the fourth embodiment will now be described.

In the neutral or closed position of the valve assembly 420 illustrated in FIG. 13, the outer sealing lip 478 of the sealing ring 438 seals against the riser pipe 434 at a location above ingress/egress portals 458, and the inner sealing lip 484 seals against the dispensing tower 436 at a location above the discharge portals 468. The sealing ring 438 is held in its illustrated neutral position by the opposing forces of the upper venting spring 444 and the lower sealing spring 442. As in the previous embodiments, the ingress/egress portals 458 and discharge portals 468 share the same gas pressure, present throughout chamber 440 due to the flow of gas among the projections 486, thereby allowing the liquid in container 426 to seek its own level away from portals 458, which in turn improves the coupling safety when a coupling arrangement is attached to the valve assembly 420.

Figure 14:
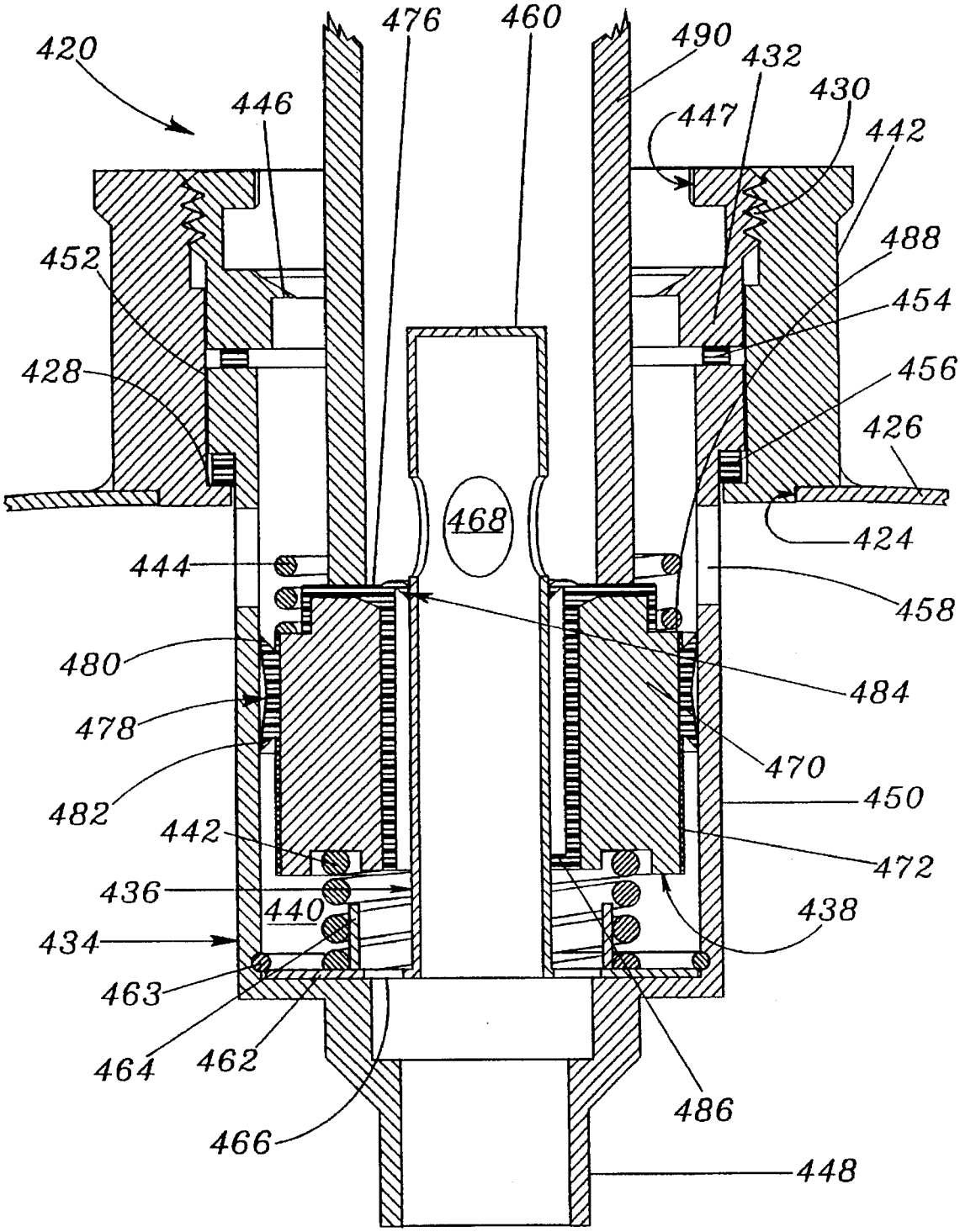
FIG. 14 is a sectional elevation view of the valve assembly of FIG. 13 and showing the valve assembly in its normal or working mode.
Figure 15:
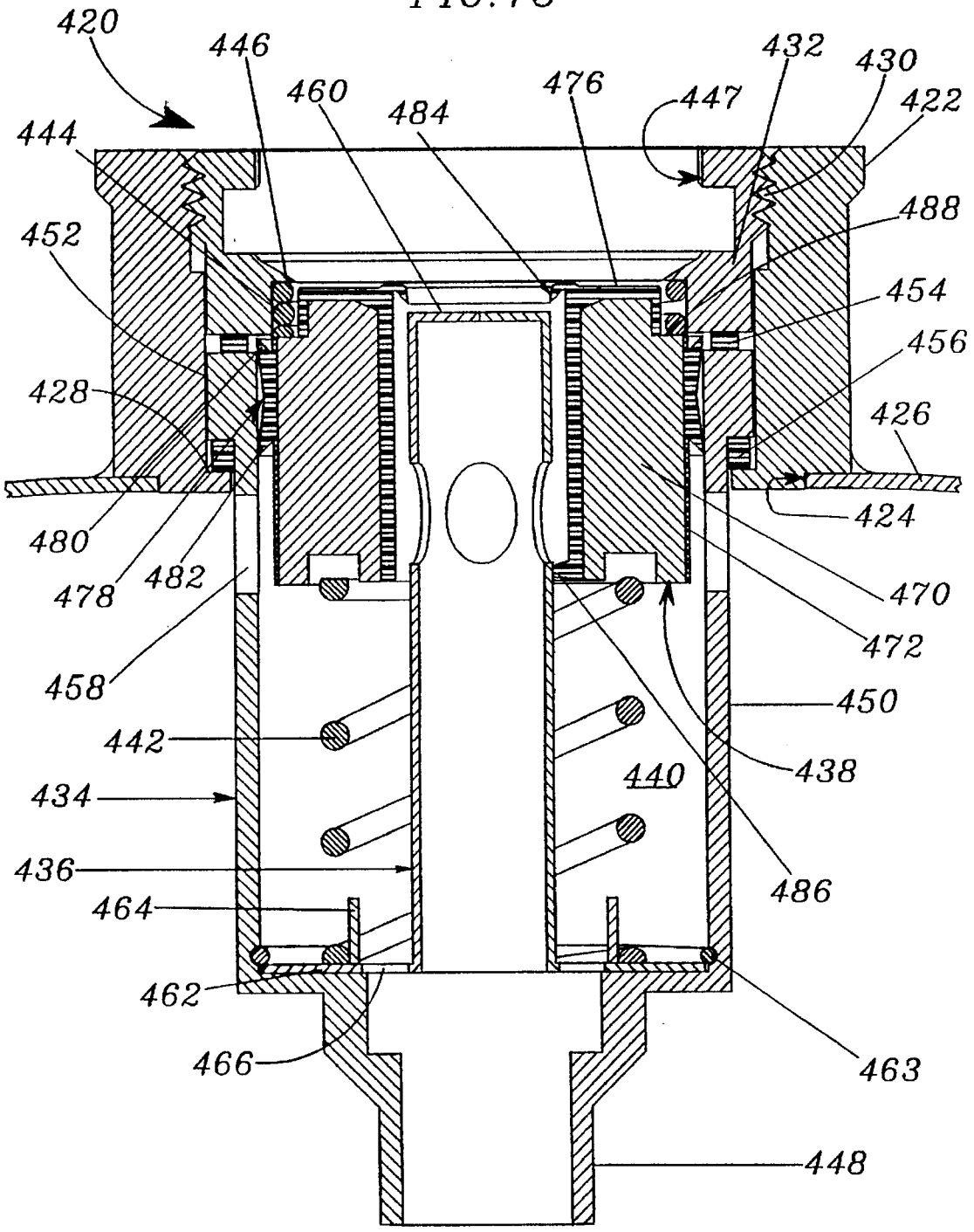
FIG. 15 is a sectional elevation view of the valve assembly of FIGS. 13 and 14 and showing the valve assembly in its pressure release or venting mode.
Figure 16:
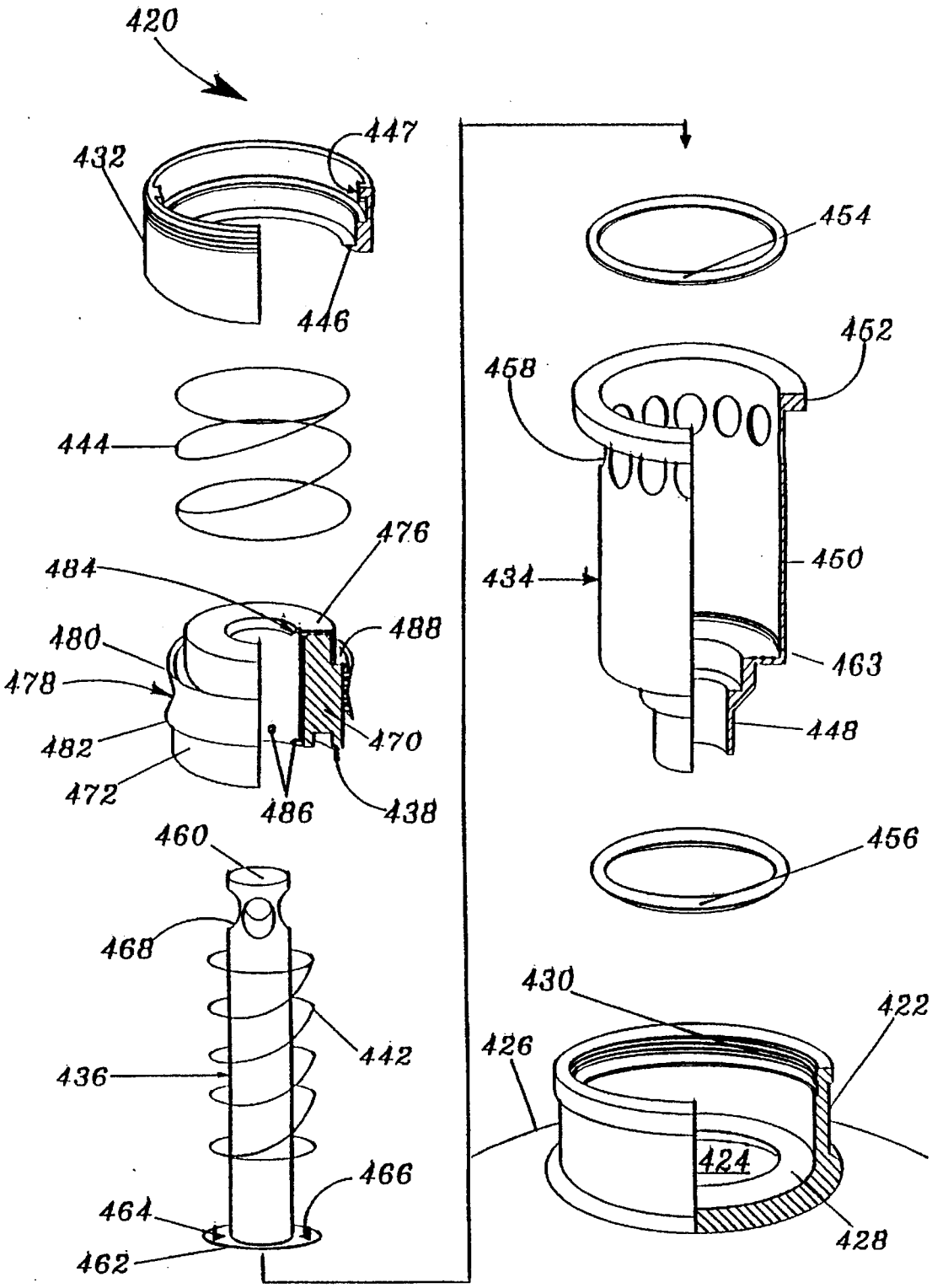
FIG. 16 is an exploded perspective view of the valve assembly of FIGS. 13–15.

Turning now to FIG. 14, the valve assembly 420 is placed in its working mode of operation in which it is open to gas ingress and liquid egress by driving the sealing ring 438 downwardly, against the force of the spring 442, using a spindle 490 of a conventional fixed external coupling arrangement. The spindle 490 comes into contact with the upper sealing face 476 of the sealing ring 438 and forces the sealing ring 438 downwardly from the position illustrated in FIG. 13 to the position illustrated in FIG. 14. As in the previous embodiments, coupling of the spindle 490 to the sealing face 476 creates an ingress tube radially outside of the spindle 490 for flow of the propellant gas into the container 426, and an egress tube within the spindle 490 for the flow liquid out of the container 426. The integrity of the gas and liquid separation at the circular line of contact between the spindle 490 and the sealing face 476 is maintained by the upward pressure of sealing spring 442. Seal integrity is enhanced further by the conical projections 486 and/or vertical ribs (not shown in this embodiment), fixed on the I.D. and/or O.D. walls of the sealing ring 438, in the manner discussed above in connection with the previous embodiments.

When the sealing ring 438 is forced downwardly to the position illustrated in FIG. 14, (1) the ingress/egress portals 458 are exposed to propellent gas flowing into the valve assembly 420 from the region surrounding the spindle 490, and (2) the discharge portals 468 are exposed to the internal fluid discharge passage or egress tube of the spindle 490. Outer sealing lip 478 prevents the propellant gas from entering the liquid at a location just below the portals 458 of riser pipe 434. Sealing lip 480 therefore preserves ingress propellant pressure integrity as pressurized gas flows into the container 426, and sealing lip 482 also prevents the liquid from entering the portals 458 of riser pipe 434, resulting in the riser pipe 434 being closed off to its gas connection. This in turn forces the gas now entering the container 426 through the portals 458 of riser pipe 434 to push the liquid up the inlet of the riser pipe 434, up through and about the center of dispensing tower 436 (enhancing the seal of sealing lip 484 in the prosess) and then out of the dispensing tower through the discharge portals 468. The discharged liquid then flows through the spindle 490 and is dispensed from the system in a conventional manner.

Conversely, when there is no external coupling attached to valve assembly 420, springs 442 and 444 return the sealing ring 438 to its neutral or closed mode as illustrated in FIG. 13, thereby containing liquid and gas within container 426 for transport. If gas pressure within the container 426 increases to excessive levels, the valve assembly 420 assumes the mode illustrated in FIG. 15 in which pent-up gas pressure within the container 426 overcomes the seal between the inner sealing lip 484 of the sealing ring 438 and the dispensing tower 436. That is, gas pressure acting on the sealing ring 438 forces the sealing ring 438 upwardly against the biasing force of the upper spring 444. Since the dispensing tower 436 is held from upward movement by the ring 463 of the riser pipe 434, the inner sealing lip 484 of the sealing ring 438 moves beyond the upper end 460 of the dispensing tower 436 to expose the discharge portals or openings 468 of the dispensing tower to the ambient atmosphere. Excess pressure within the container 426 can then flow past the riser pipe 434, through ingress/egress portals 458, through the dispensing tower 436, and out of the valve assembly 420 through the discharge portals 468.

6. Advantages of Invention

The container valve assembly according to the present invention, having the above-mentioned construction, exhibits several benefits. It can be retrofitted to millions of existing, potentially unsafe containers while at the same time using less parts within the same space than previously-known valve assemblies. The inventive valve assembly therefore exhibits greater cross-sectional ingress and egress areas than previously-known valve assemblies, thereby improving fill rates and reducing costs to the users. It also can control the internal pressure of a container and is adjustable by simply changing a spring and/or spacer. The valve assembly is bi-directional and is able to use the same portals for both gas and liquid. In addition, it is able to share the same chamber with a gas and a liquid, keeping them separated when working yet together when at rest so as not to allow liquid to be present at coupling transition points. The sealing ring of the valve assembly may be formed from a single molded polymer member that dose not have to be rigidified if design need not require so. The valve also is sequentially timeable with regards to the fixed portal locations of the valve housing and the fixed sealing lip locations on the moving molded polymer sealing ring, thereby allowing the valve to mix more then one liquid or gas in the same chamber, with the differential between them being controllable by design. The sealing ring may take the form of a molded polymer sealing ring that can act as a control spring and replace the venting spring as illustrated in the embodiment of FIGS. 9–12 by virtue of its inherent elongation and ability to displace under pressure when not rigidified. The sealing ring of the valve assembly also can maintain perpendicularity and eccentricity with the use of a plurality of conical projections and/or vertical ribs fixed to its I.D. and/or O.D or even the mating dispensing tower as illustrated in FIGS. 9–12. The valve assembly also can control pressure on either side of a single movable molded polymer sealing ring. In addition, the sealing ring of the invention can be used in combination with various types of reciprocating members, e.g. with hydraulic piston valve, even though a container valve is its present preferred conveyance and benefactor.

Although the invention has been described through its specific forms, it is to be understood that various changes and modifications may be imparted thereto without departing from the scope of the invention.

I claim:

1. A valve assembly for selectively permitting a liquid to be dispensed from a container under gas pressure within said container, said valve assembly comprising:

(A) a riser pipe configured for mounting in an opening in said container, said riser pipe having an internal surface, a first end located remote from said opening, and a second end located adjacent said opening, an ingress/egress portal being formed in said riser pipe between said first and second ends thereof;

(B) a dispensing tower positioned radially within said riser pipe, said dispensing tower having an external surface and extending at least generally in parallel with said riser pipe, a chamber being formed between said external surface of said dispensing tower and said internal surface of said riser pipe; and (C) a sealing ring which is positioned within said chamber and which is slidable downwardly within said chamber (1) from a first position in which said sealing ring seals against said internal surface of said riser pipe at a location above said ingress/egress portal, and in which said sealing ring seals against said external surface of said dispensing tower and prevents fluid from flowing out of said valve assembly, and (2) to a second position in which said sealing ring seals against said internal surface of said riser pipe at a location beneath said ingress/egress portal and in which said sealing ring permits fluid to flow out of said valve assembly.

2. A valve assembly as defined in claim 1, wherein the relative positional relationship between said sealing ring, said riser pipe, and said dispensing tower is variable such that, in the event of a build-up of excessive gas pressure within said container, a pressure relief operation automatically commences in which at least one of said sealing ring and said dispensing tower move axially relative to said riser pipe such that said sealing ring seals against said internal surface of said riser pipe at a location above said ingress/egress portal, and such that fluid is free to flow out of said valve assembly.

3. A valve assembly as defined in claim 2, wherein, during said pressure relief operation, said sealing ring remains stationary and said dispensing tower moves upwardly.

4. A valve assembly as defined in claim 3, further comprising a spring which urges against said dispensing tower and said sealing ring and which resists upward movement of said dispensing tower during said pressure relief operation.

5. A valve assembly as defined in claim 4, wherein said spring is a first spring which has an upper end seated on a spacer and a lower end seated on said dispensing tower, and further comprising a second spring which is concentric with and which surrounds said first spring and which has an upper end seated on said sealing ring and a lower end seated on said riser pipe.

6. A valve assembly as defined in claim 3, wherein said dispensing tower has a hollow interior and has a discharge portal formed therein at a location near an upper end thereof, a sealing lip is formed on said internal surface of said sealing ring, said sealing lip 1) being positioned above said discharge portal of said dispensing tower when said sealing ring is in said first position, 2) being positioned beneath said discharge portal of said dispensing tower when said sealing ring is in said second position, and 3) being positioned beneath said discharge portal of said dispensing tower during said pressure relief operation.

7. A valve assembly as defined in claim 3, wherein said dispensing tower includes 1) a head, and 2) a shank which extends downwardly from said head, said shank having a diameter which is smaller than a diameter of said head, a downwardly-facing shoulder being formed at an interface between said shank and said head, an upwardly-facing sealing face is formed on an inner peripheral surface of said sealing ring between upper and lower ends thereof, said sealing face normally sealingly engaging said shoulder, and wherein upon movement of said sealing ring from said first position to said second position, said sealing face of said sealing ring becomes disengaged from said shoulder of said dispensing tower to form a space between said sealing ring and said dispensing tower and to permit fluid to flow between said sealing ring and said dispensing tower and out of said valve assembly.

8. A valve assembly as defined in claim 2, wherein, during said pressure relief operation, said dispensing tower remains stationary and said sealing ring moves upwardly.

9. A valve assembly as defined in claim 8, further comprising a first spring which urges against an upwardly-facing surface of said sealing ring and which resists upward movement of said sealing during said pressure relief operation, and a second spring which urges against a downwardly-facing surface of said sealing ring and which resists movement of said sealing ring from said first position towards said second position.

10. A valve assembly as defined in claim 3, wherein said dispensing tower has a hollow interior and has a discharge portal formed therein at a location near an upper end thereof, a sealing lip is formed on an inner peripheral surface of said sealing ring, said sealing lip 1) being positioned above said discharge portal of said dispensing tower when said sealing ring is in said first position, 2) being positioned beneath said discharge portal of said dispensing tower when said sealing ring is in said second position, and 3) being positioned beneath said discharge portal of said dispensing tower during said pressure relief operation.

11. A valve assembly as defined in claim 1, further comprising a plurality of centering projections which extend from said sealing ring to said dispensing tower and which engage said dispensing tower while permitting fluid flow therepast so as to guide and stabilize the perpendicularity and eccentricity between said sealing ring, said dispensing tower, and said riser pipe.

12. A valve assembly as defined in claim 1, wherein said sealing ring is formed from an inner, rigid insert surrounded by a layer of a molded polymeric material.

13. A valve assembly as defined in claim 12, wherein said insert is formed from a thermally degradable material.

14. A valve assembly as defined in claim 10, wherein said ingress/egress portal and said discharge portal are in free fluid communication with one another when said sealing ring is in said first position and are sealed from one another when said sealing ring is in said second position.

15. A valve assembly for selectively permitting a liquid to be dispensed from a container under gas pressure within said container, said valve assembly comprising:

(A) a riser pipe configured for mounting in an opening in said container, said riser pipe having a first end located remote from said opening and a second end located adjacent said opening, a plurality of circumferentially-spaced ingress/egress portals being formed in said riser pipe between said first and second ends thereof;

(B) a hollow dispensing tower positioned radially within said riser pipe and extending at least generally in parallel with said riser pipe, a plurality of circumferentially-spaced discharge portals being formed in said dispensing tower near an upper end thereof for fluid egress, an annular chamber being formed between an external surface of said dispensing tower and an internal surface of said riser pipe; and (C) a sealing ring which is positioned within said chamber and which is slidable downwardly within said chamber under the imposition of an externally-applied downward force 1) from a first position in which said sealing ring seals against said internal surface of said riser pipe at a location above said ingress/egress portals and in which said sealing ring seals against said external surface of said dispensing tower at a location above said discharge portals and prevents liquid from flowing out of said valve assembly, and 2) to a second position in which said sealing ring seals against said internal surface of said riser pipe at a location beneath said ingress/egress portals and in which said sealing ring seals against said external surface of said dispensing tower at a location beneath said discharge portals and permits liquid to flow out of said valve assembly, said sealing ring including (1) a first sealing lip which extends radially outwardly from said sealing ring and which engages and seals against said internal surface of said riser pipe, (2) a second sealing lip which extends radially inwardly from said sealing ring and which engages and seals against said external surface of said dispensing tower, and (3) a plurality of centering projections which extend away from said inner peripheral surface of said sealing ring and which engage said dispensing tower while permitting fluid flow therepast, thereby to 1) guide and stabilize the perpendicularity and eccentricity between said sealing ring, said dispensing tower, and said riser pipe, and 2) enhance the sealing ability of said first and second sealing lips; and (D) a spring which has 1) an upper end which urges against a downwardly-facing surface of said sealing ring and 2) a lower end which urges against an upwardly-facing surface of said dispensing tower, wherein the relative positional relationship between said sealing ring, said riser pipe, and said dispensing tower is variable such that, during a pressure relief operation occurring upon a build-up of excessive gas pressure within said container, at least one of said sealing ring and said dispensing tower move axially upwardly relative to said riser pipe such that said sealing ring seals against said internal surface of said riser pipe at a location above said ingress/egress portals, and such that pressurized gas is free to flow through said discharge portals and out of said valve assembly.

16. A sealing ring for a valve assembly, said sealing ring comprising an annular member at least an external portion of which is formed from a polymeric material, wherein (A) a first sealing surface is provided on an outer peripheral surface of said sealing ring for sealing against a first member and for preventing fluid flow axially past said first sealing surface, said first sealing surface comprising a sealing lip which extends outwardly from said outer peripheral surface, (B) a second sealing surface is provided on an inner peripheral surface of said sealing ring for sealing against a second member and for preventing fluid flow axially past said second sealing surface, and (C) a plurality of centering projections extend away from at least one of said inner peripheral surface and said outer peripheral surface for engaging at least one of said first member and said second member while permitting fluid flow therepast, thereby maintaining a designated positional relationship between said sealing ring and said at least one member.

17. A sealing ring as defined in claim 16, wherein said first sealing surface comprises a sealing lip which is V-shaped and which includes an upper sealing surface and a lower sealing surface both of which engage said first member and between which is formed an annular space.

18. A sealing ring as defined in claim 17, wherein said first sealing surface further comprises a slender annular face rib which is formed on said sealing lip in the vicinity of one of said upper sealing surface and said lower sealing surface and which is configured to engage said first member.

19. A sealing ring defined in claim 16, wherein each of said projections comprises a frusto-conical member formed integrally with said sealing ring.

20. A method of controlling the flow of a liquid from a container, said container having an opening formed therein in which is inserted a riser pipe and a dispensing tower, an annular chamber being formed between said riser pipe and said dispensing tower, an ingress/egress portal being formed in said riser pipe, said method comprising:

(A) mechanically driving a sealing ring to move downwardly within said chamber (1) from a first position preventing gas or liquid flow out of said container, and (2) to a second position in which gas flow through said ingress/egress portal from above said sealing ring and liquid flows past said sealing ring from below and out of said container; and (B) generating gas pressure of above a designated magnitude within said container, wherein said gas pressure causes at least one of said sealing ring and said dispensing tower to move axially relative to said riser pipe such that (1) said sealing ring seals against said riser pipe at a location above said ingress/egress portal, and such that (2) gas is free to flow out of said container, thereby relieving said gas pressure.

21. A method of controlling the flow of a liquid from a container, said container having an opening formed therein in which is inserted a riser pipe and a dispensing tower, an annular chamber being formed between said riser pipe and said dispensing tower, an ingress/egress portal being formed in said riser pipe, said method comprising:

mechanically driving a sealing ring to move downwardly within said chamber (1) from a first position preventing gas or liquid flow out of said container, and (2) a second position in which gas flows through said ingress/egress portal from above said sealing ring and liquid flows past said sealing ring from below and out of said container, wherein, as said sealing ring moves from said first position thereof to said second position thereof, said sealing ring isolates said ingress/egress portal from pressurized liquid in said riser pipe.

22. A method of controlling the flow of a liquid from a container, said container having an opening formed therein in which is inserted a riser pipe and a dispensing tower, an annular chamber being formed between said riser pipe and said dispensing tower, an ingress/egress portal being formed in said riser pipe, said method comprising:

(A) mechanically driving a sealing ring to move downwardly within said chamber (1) from a first position preventing gas or liquid flow out of said container, and (2) to a second position in which gas flows through said ingress/egress portal from above said sealing fine and liquid flows past said sealing ring from below and out of said container; and (B) setting the interval between initial downward movement of said sealing ring and valve opening by selecting a designated positional relationship between said portion of said sealing ring and said ingress/egress portal.

* * * * *

UNITED STATES PATENT AND TRADEMARK OFFICE

CERTIFICATE OF CORRECTION

PATENT NO. : 5,645,192
DATED : July 8, 1997
INVENTOR(S) : Amidzich

It is certified that error appears in the above-identified patent and that said Letters Patent is hereby corrected as shown below:

Title page,
Item [60], change "1996" to -- 1995 --.

Column 1,
Line 11, change "1996" to -- 1995 --.

Signed and Sealed this

Fourteenth Day of May, 2002

*Attest:*

*Attesting Officer*

JAMES E. ROGAN
*Director of the United States Patent and Trademark Office*